US006173558B1

(12) United States Patent
Burke, Jr.

(10) Patent No.: US 6,173,558 B1
(45) **Date of Patent: *Jan. 16, 2001**

(54) EXTENDABLE STIRRUP

(76) Inventor: Earl P. Burke, Jr., 101 Westcott #201, Houston, TX (US) 77007

( * ) Notice: Under 35 U.S.C. 154(b), the term of this patent shall be extended for 0 days.

This patent is subject to a terminal disclaimer.

(21) Appl. No.: 09/468,573

(22) Filed: Dec. 21, 1999

Related U.S. Application Data

(63) Continuation-in-part of application No. 09/104,101, filed on Jun. 24, 1998, now Pat. No. 6,026,633.
(60) Provisional application No. 60/050,775, filed on Jun. 25, 1997, and provisional application No. 60/113,616, filed on Dec. 23, 1998.

(51) Int. Cl.[7] ..... B68C 3/00
(52) U.S. Cl. ..... 54/47
(58) Field of Search ..... 54/47, 48, 49.5

(56) References Cited

U.S. PATENT DOCUMENTS 6,026,633 * 2/2000 Burke, Jr. ..... 54/47

FOREIGN PATENT DOCUMENTS

2258772 * 8/1975 (FR) ..... 54/47
509 * of 1875 (GB) ..... 54/48

* cited by examiner

*Primary Examiner*—Robert P. Swiatek
(74) *Attorney, Agent, or Firm*—Conley, Rose & Tayon

(57) ABSTRACT

The extendable stirrup includes an upper stirrup, a lower stirrup slidably connected to the upper stirrup, a lock, a release and a retraction mechanism. The upper stirrup is a full stirrup, which includes an upper foot plate to support the rider's foot during riding and which attaches in a known manner to the stirrup strap of a saddle. The lower stirrup slides between retracted and extended positions on the upper stirrup and can be extended downward to give the rider a lower "step" for mounting the horse. A lock is disposed on the upper and lower stirrups and engages in the extended position locking the lower stirrup in the extended position. A release disengages the lock upon downward movement of the lower stirrup or, in an alternative embodiment, upon pressure applied to a trigger on the upper foot plate when the lower stirrup is in the extended position. In either embodiment, when the release disengages, the lower stirrup automatically retracts toward the upper stirrup. With the lower stirrup is in the retracted position, the upper and lower stirrups remain nested together to detract less from the aesthetic appeal of the rider, the riding gear, and the horse.

42 Claims, 17 Drawing Sheets

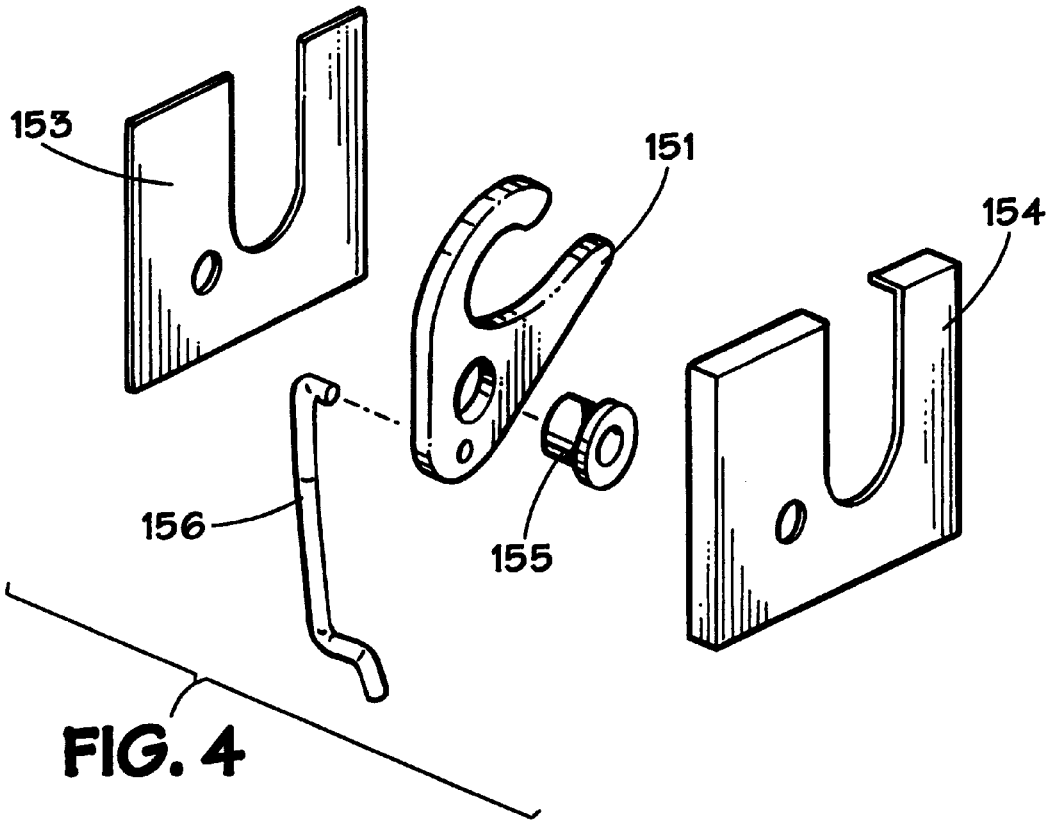
FIG. 4
FIG. 7
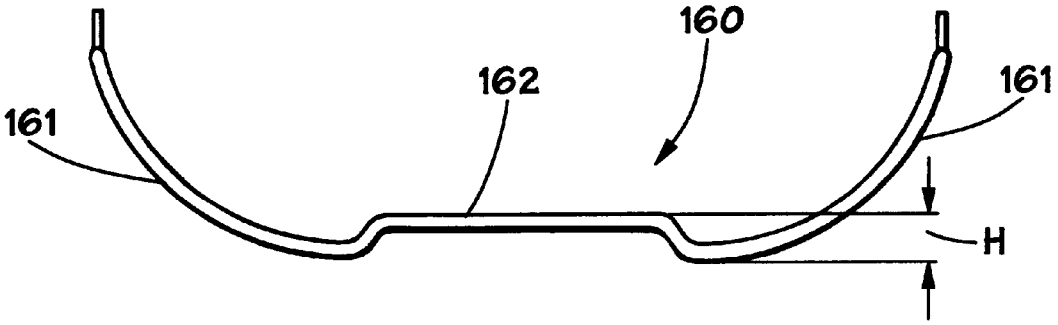

FIG. 11A
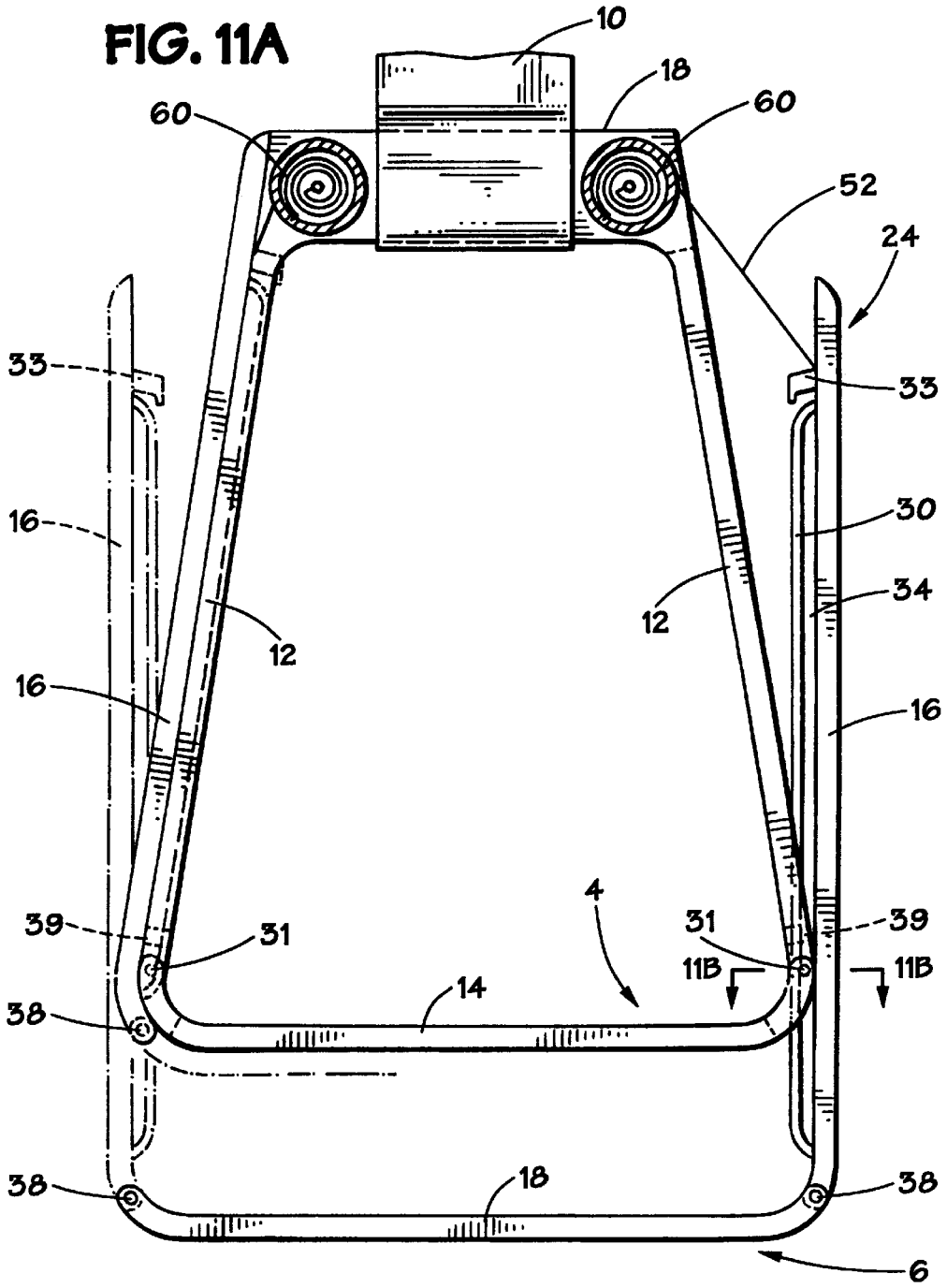
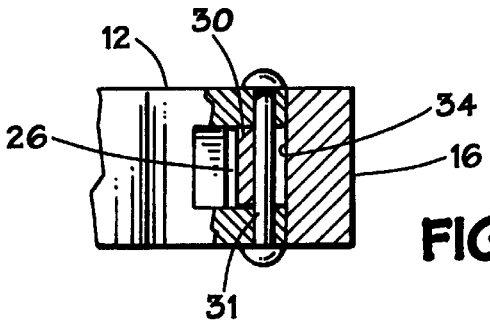
FIG. 11B

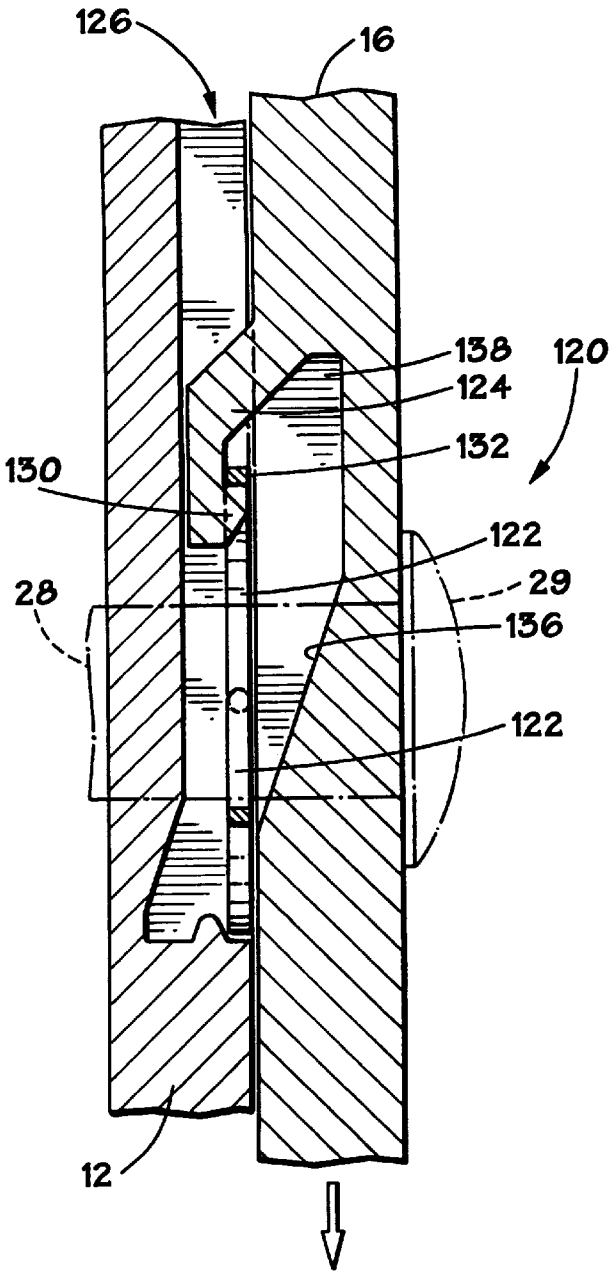
FIG. 13B
FIG. 13A
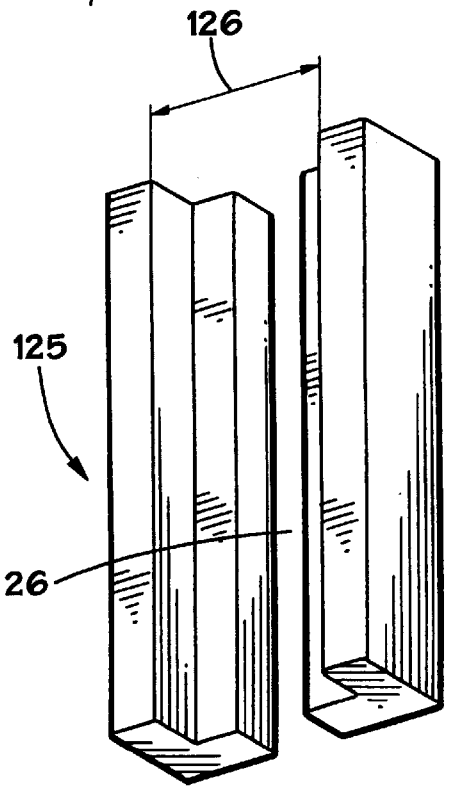

EXTENDABLE STIRRUP

CROSS-REFERENCE TO RELATED APPLICATIONS

This application is a continuation-in-part of co-pending U.S. Utility application Ser. No. 09/104,101, filed Jun. 24, 1998, now U.S. Pat. No. 6,026,633, which claims the benefit of 35 U.S.C. 119(e) of U.S. Provisional Application No. 60/050,775, filed on Jun. 25, 1997, and also claims the benefit of 35 U.S.C. 119(e) of U.S. Provisional Application No. 60/113,616, filed Dec. 23, 1998. U.S. Utility Application Ser. No. 09/104,101, U.S. Provisional Application 60/050,775, and U.S. Provisional Application No. 60/113,616 are each hereby incorporated herein by reference.

FIELD OF THE INVENTION

The present invention relates generally to riding equipment for riding an animal, and more particularly to extendible stirrups for aiding a rider, including an equestrian rider, to mount a horse.

BACKGROUND OF THE INVENTION

A common problem encountered by equestrian riders is difficulty in mounting their horses. This problem is particularly prevalent for shorter, younger, or physically challenged riders. These riders often need assistance to mount the horse. Typically, this assistance is provided by another person or with the use of an elevated object such as a step or pedestal placed beside the horse. This problem is compounded when external assistance is unavailable or inconvenient. If the need for external mounting aid can be eliminated, horseback riding will be more accessible to the above-mentioned group of riders. The construction of riding saddles and accessories suited to shorter riders, younger riders, and riders with decreased mobility presents special challenges.

The prior art includes several devices designed to aid a rider to mount a horse. A first such device is the separate mounting stirrup. The separate mounting stirrup attaches to the saddle and hangs closer to the ground than a riding stirrup. One deficiency of the separate mounting stirrup is that it remains attached to the saddle during riding. The separate mounting stirrup can frighten both the horse and the rider by flapping around during a brisk ride and can also snag on brush and downed trees. A second such device is the stirrup extension. Some stirrup extensions are also inconvenient, because they too remain extended during riding. Other stirrup extensions lack the rigidity to solidly support the rider as he or she mounts the horse. They either sag under the rider's weight or rotate too easily. Similar mechanical inadequacies are inherent in many prior art mounting aids.

Various mounting aids have been developed for English riding gear. However, these aids are not always adaptable to riding taller and more difficult to mount horses. Many known mounting aids also detract from the aesthetic appearance of the horse, rider, and riding gear.

The present invention is directed to overcoming the deficiencies of the prior art set forth above.

SUMMARY OF THE INVENTION

The present invention is directed to an extendable stirrup which includes an upper stirrup, a lower stirrup slidably connected to the upper stirrup, a lock for locking the lower stirrup in the extended position, a release for releasing the lock, and a retraction mechanism for retracting the lower stirrup to the non-extended or retracted position. The upper stirrup is a full stirrup, which includes an upper foot plate to support the rider's foot during riding, and which attaches in a known manner to the stirrup strap of a saddle. The lower stirrup slides on the upper stirrup between the retracted and extended positions and can be extended downward to give the rider a lower "step" for mounting the horse.

The lock is disposed on the upper and lower stirrups and engages in the extended position locking the lower stirrup in the extended position. In one embodiment of the release, the release disengages the lock upon another downward movement of the lower stirrup with respect to the upper stirrup or, in another embodiment of the release, pressure is applied to a trigger on the upper foot plate while the lower stirrup is in the extended position, to release the lock. In either embodiment, when the release mechanism disengages, the retraction mechanism causes the lower stirrup to automatically retract toward the upper stirrup. In the retracted position, the upper and lower stirrups remain snugly nested together so as not to detract from the aesthetic appeal of the rider, the riding gear, and the horse. The upper and lower stirrups may be fabricated of wood, laminated wood, hard plastic, steel, aluminum, or other rigid materials that do not substantially give under a rider's weight and the lower foot plate may pivot to aid in the movement of the rider's foot in the stirrup. Finally, when using the present invention, it is important that the saddle be snug and tight on the animal. This will prevent the saddle from sliding towards the mounting rider, thereby allowing maximum benefit from the present invention.

Other objects and advantages of the invention will become apparent upon reading the following detailed description and upon reference to the Figures.

BRIEF DESCRIPTION OF THE DRAWINGS

For a detailed description of a preferred embodiment of the invention, reference will now be made to the accompanying drawings wherein:

FIG. 4 is an exploded view of the hook and housing plate assembly for the locking mechanism shown in FIG. 3;

FIG. 7 is an enlarged view of the release shown in FIG. 3;

FIG. 11A is an elevation view of yet another embodiment of the stirrup of the present invention showing another retraction mechanism and sliding attachment in which track bars guide the sliding of the lower stirrup along the upper stirrup;

FIG. 11B is a section view taken at plane 11B—11B in FIG. 11A showing the track bar and a thin bolt retaining the track bar in a longitudinal slot of the embodiment of FIG. 11A;

FIG. 13A is a perspective view of a portion of the outer face of one of the upper side members of the stirrup for use with still another embodiment of the lock for locking the lower stirrup in extended position;

FIG. 13B is a cross-sectional view of the lock for use with the stirrup partially illustrated in FIG. 13A locking the lower stirrup in the extended position;

Figure 1:
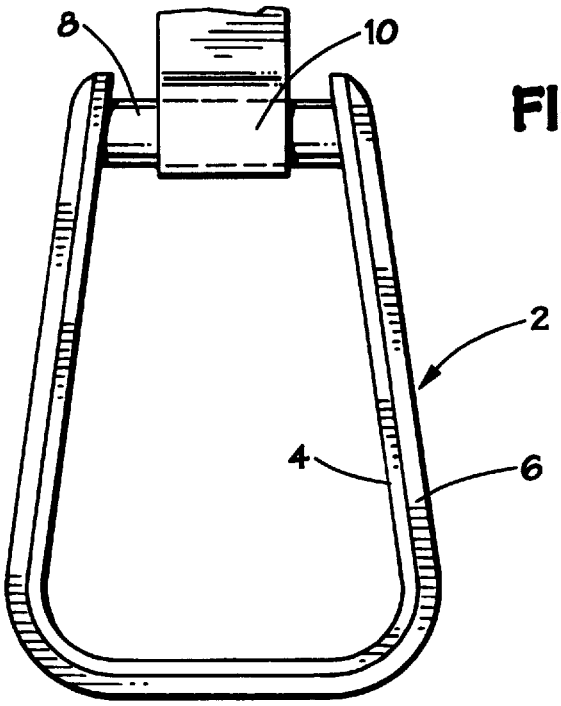
FIG. 1 is an elevation view of one embodiment of the stirrup of the present invention in a retracted position.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation of each embodiment are described in this specification. It will of course be appreciated that numerous implementation-specific decisions are made to achieve specific objectives for a particular embodiment. Moreover, it will be appreciated that, even if such a design effort might be complex and time-consuming, it would nevertheless be a routine undertaking for those of ordinary skill in the art having the benefit of this disclosure.

The various alternative embodiments of extendible stirrups in accordance with the present invention include upper stationary stirrup and a lower extendable stirrup with the lower stirrup being adjustable between an extended and a retracted position. The upper stirrup is a full stirrup having has an upper foot plate and being attached in a known manner to the stirrup strap of a saddle. The upper stirrup supports a rider's foot during riding. The lower stirrup slidably attaches to the upper stirrup and has a lower foot plate that can be extended to a lower elevation to provide the rider with a lower "step" for mounting the horse. Thus, the rider need not raise his or her foot all the way up to the upper foot plate of the upper riding stirrup to mount the horse. In one embodiment, the lower stirrup automatically retracts from the extended to the retracted position when the rider's foot is removed from the lower stirrup. In an another embodiment, the lower stirrup retracts to the retracted position when a release trigger is activated on the upper foot plate. When the rider is positioned on the riding horse, the upper and lower stirrups remain snugly together in the retracted position and do not detract from the aesthetic appeal of the rider, the riding gear, and the horse.

Referring initially to FIG. 1, one embodiment of an extendible stirrup 2 is shown in the retracted or riding position. The extendible stirrup 2 includes upper and lower stirrups 4, 6 and a crossbar 8. Upper stirrup 4 may be referred to as the primary stirrup and the lower stirrup 6 may be referred to as the extendable stirrup. The stirrups 4, 6 and crossbar 8 may be fabricated of wood, laminated wood, hard plastic, steel, aluminum, or other rigid materials that do not substantially give under a rider's weight. A stirrup strap 10 wraps around the crossbar 8 to attach the extendible stirrup 2 to a saddle (not shown). In the illustrated embodiment, the upper and lower stirrups 4, 6 each narrows substantially at the mouth formed by the U-shape across which extends the crossbar 8. It should be appreciated that the stirrups of the present invention may be used with western-style riding stirrups of any shape or design including but not limited to the "deep roper," "cutter," "bell," and "oxbow" designs. In some embodiments, the upper and lower stirrups 4, 6 do not substantially narrow or widen toward the mouth. As shown in FIG. 1, when in the retracted position, the lower stirrup 6 rests snugly and is nested against the upper stirrup 4.

Figure 2B:
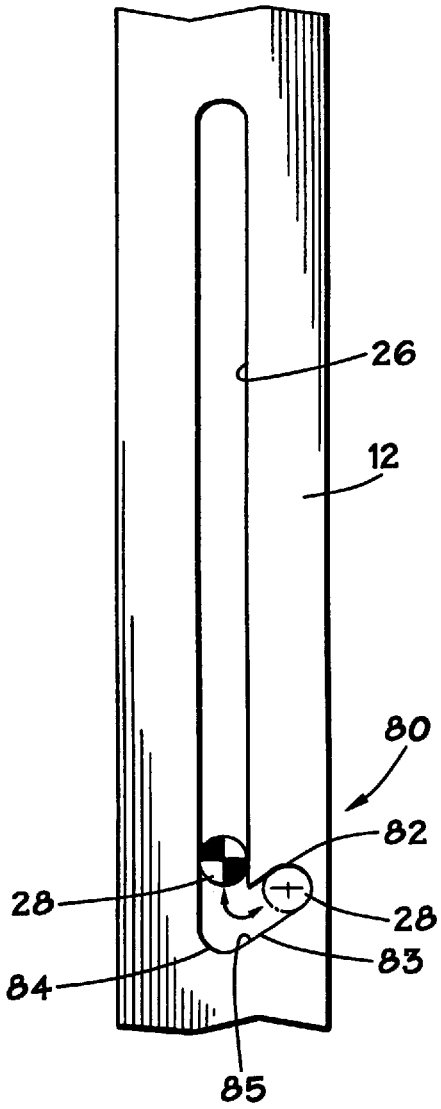
FIG. 2B is a partial side elevation view of the preferred embodiment of the lock showing a J-shaped extension of the longitudinal slot of FIG. 2A for locking the lower stirrup in the extended position.
Figure 2A:
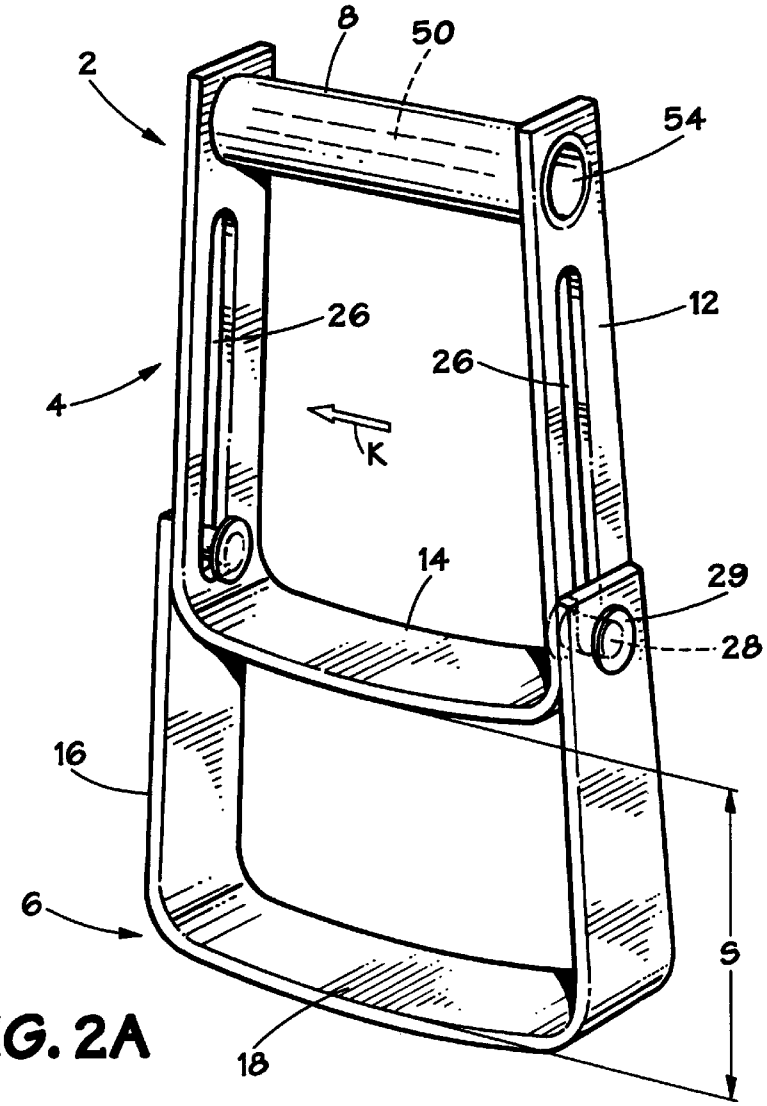
FIG. 2A is a perspective view of a particular embodiment of the extendable stirrup of FIG. 1.

FIG. 2A is a view of the extendible stirrup 2 of FIG. 1 in the extended position. The upper stirrup 4 has two upper side members 12 and an upper foot plate 14. The upper side members 12 have longitudinal slots 26. The lower stirrup 6 has two lower side members 16 and a lower foot plate 18. In the preferred embodiment, the inside width between the two lower side members 16 approximates the outside width of the two upper side numbers 12 such that the upper stirrup 4 is received within the lower stirrup 6. The step height S is the distance between the lower foot plate 18 and the upper foot plate 14 when lower stirrup 6 is in the extended position. Preferably, the step height S is between four and five inches (10.16–12.7 cm), and preferably is between four and a quarter and four and one-half inches (11.43 cm).

Protrusions 28 provide a sliding attachment between stirrups 4, 6 to guide the sliding of the lower stirrup 6 on upper stirrup 4. In the particular embodiment illustrated, the protrusions are bolts 28, although the invention is not so limited and the upper stirrup 4 slides within the lower stirrup 6. As detailed in FIGS. 2A and 2B, bolt heads 29 slidingly engage the interior side of upper side members 12 to maintain the attachment of upper and lower stirrups 4, 6. To increase the smoothness of the sliding motion of the lower stirrup 6, the outer diameter of the protrusions 28 preferably closely matches the width of the longitudinal slots 26 such that there is sliding engagement between the shaft of bolts 28 and the edges forming slots 26. The lower stirrup 6 is adapted to slide smoothly along a portion of the length of the two upper side members 12 of upper stirrup 4.

Referring now to FIG. 2B, there is shown a side view of an upper side 12 viewed in the direction of arrow K in FIG. 2A. More particularly, FIG. 2B shows the preferred embodiment 80 of a lock for locking the lower stirrup 6 in the extended position. Lock 80 includes a slot extension 82 at the bottom of each of the longitudinal slots 26 of the upper sides 12 of upper stirrup 4. The slot extension 82 includes a J-shaped slot 83 and a notch 84. The width of the longitudinal slots 26 and J-shaped slots 83, and the diameter of bolt 28, are substantially equal and preferably about 0.95 cm (0.375 inches) in one embodiment.

Figure 2C:
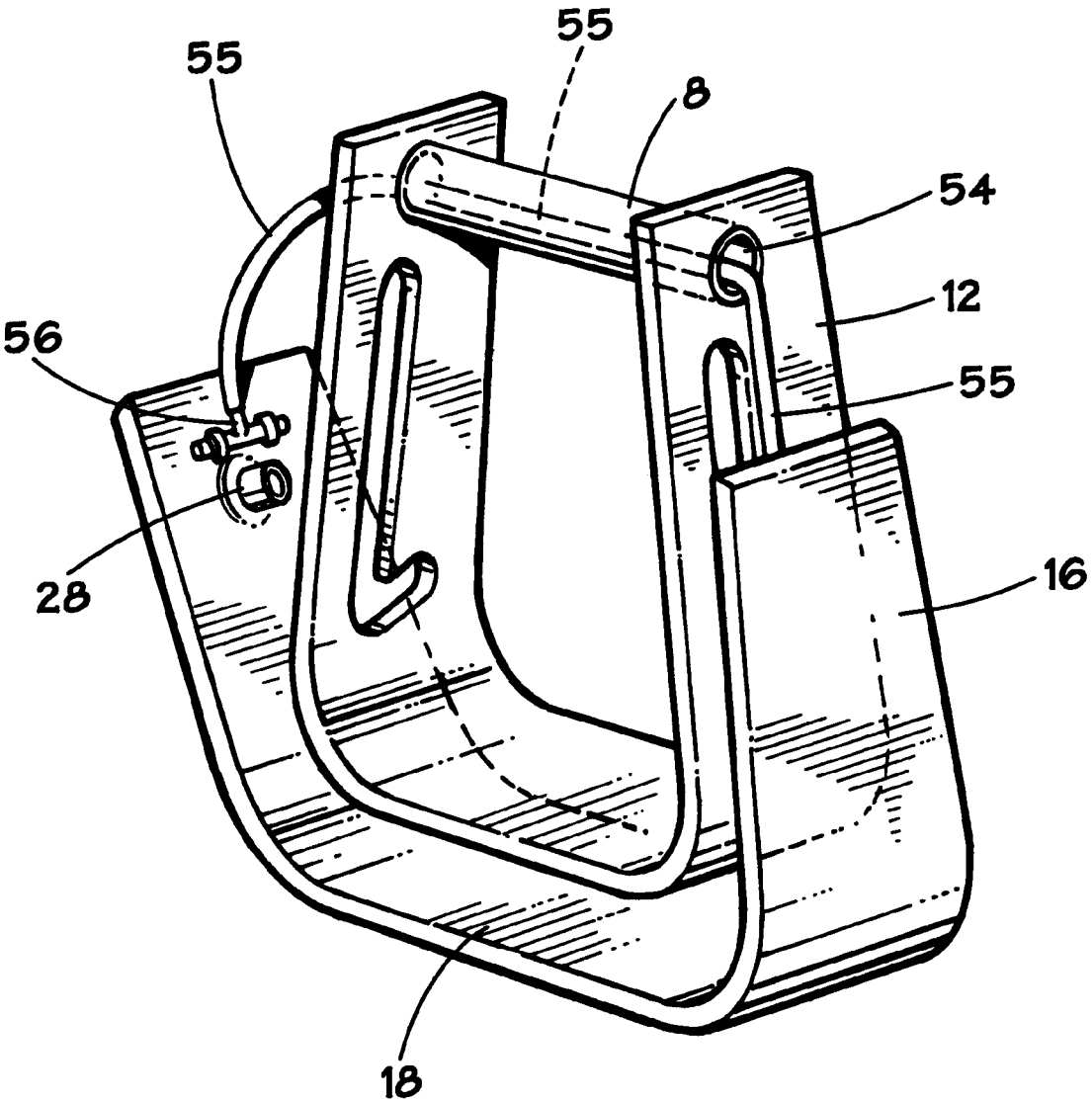
FIG. 2C is an exploded perspective view of an embodiment of the retraction mechanism.

Referring particularly to FIGS. 2A and 2C, the crossbar 8 is, at least, partially hollow to house a retraction mechanism 50. The retraction mechanism 50 may be one of several embodiments such as an elastic material (such as an elastomeric cord), a torsion spring, or a pair of coil springs. One embodiment uses "constant force springs" or "power springs" manufactured by Vulcan Spring and Manufacturing Company, 501 School House Road, Telford, Pa. 18969 In FIG. 2C, the retraction mechanism 50 includes an elastomer cord 55. Elastomer cord 55 passes through crossbar 8 and then through longitudinal holes 54 in the upper side members 12. Each end of the elastomer cord 55 couples to a T-bolt 56 attached to the inside of lower side members 16. The elastomer cord 55 keeps the lower stirrup 6 under a tension, biasing to the retracted position nested against the upper stirrup 4.

Hand pressure suffices to extend the lower stirrup 6 to position bolt 28 in the bottom of slot extension 82. A slight forward or backward movement (depending on whether slot extension 82 is to the front or rear of the extendable stirrup) moves the bolt 28 into J-shaped slot 83. The retraction mechanism 50 raises the bolt 28 in slot extension 82 and maintains the bolt 28 in against the top of slot extension 82. Additional pressure from the rider's weight on the lower foot plate 18 causes the bolt 28 to slide downward in extension slot 82 to notch 84. Extension slot 82 has a downwardly tapered bottom side carrying bolt 28 to notch 84. Then, under the tension of the retraction mechanism 50, the bolt 28 slides back up the longitudinal slot 26 above notch 84, returning the lower stirrup 6 to the retracted position.

Figure 5:
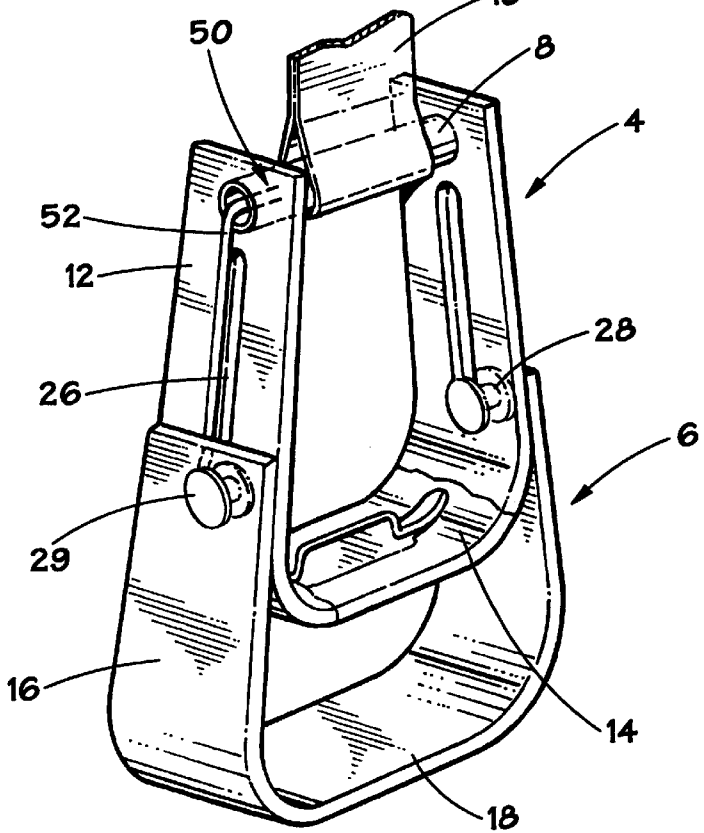
FIG. 5 is a perspective view of another embodiment of the extendable stirrups of the present invention showing a release for the lock while in the extended position.
Figure 3:
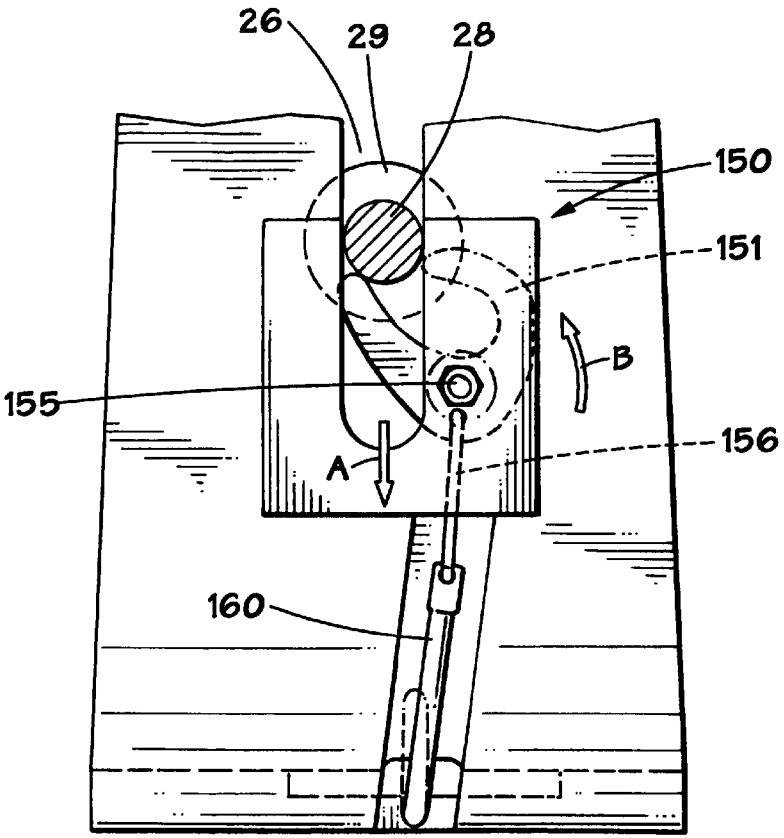
FIG. 3 is a side elevation view of another embodiment of a locking mechanism shown in the unlocked position.

Turning now to FIGS. 3—9B, there is illustrated another lock 150 for locking the lower stirrup 6 in the extended position and a release 160 for releasing the lock 150. Referring specifically to FIG. 3, lock 150 includes a hook 151 disposed on the upper stirrup 4 and a bolt 28 disposed on the lower stirrup 6 that extends into the longitudinal slots 26 in each upper side member 12 so as to cause no protrusions. Referring particularly to FIGS. 3 and 4, the hook 151 is pivotally secured to the upper side member 12 by an inner housing plate 153, an outer housing plate 154, and a passthrough pivot bolt 155. Preferably, the housing plate 154 is fastened to the outer sides of upper side members 12 and is counter-sunk or recessed into the outer sides of upper side members 12. Having the housing plate 154 counter-sunk or recessed ensures that the outer surface of the upper side members 12 is smooth, allowing easy and unobstructed sliding motion between the lower side members 16 and the upper side members 12. The pivot bolt 155 passes through the housing plates 153, 154 and secures the housing plates 153, 154 to the upper side member 12. The pivot bolt 155 is also counter sunk or recessed to ensure that the inner and outer surfaces of the upper side members 12 are smooth, thus allowing easy sliding motion between the lower side members 16 and the upper side members 12 and keeping the inside of the upper side members 12 free from impediment in their sliding engagement. The housing plates 153, 154 are preferably made of stainless steel. Referring to FIG. 5, the bolt 28 is coupled to the retraction mechanism 50 housed within the crossbar 8 of the upper stirrup 4. The retraction mechanism 50 biases the bolt 28 towards the retracted position.

Figure 6:
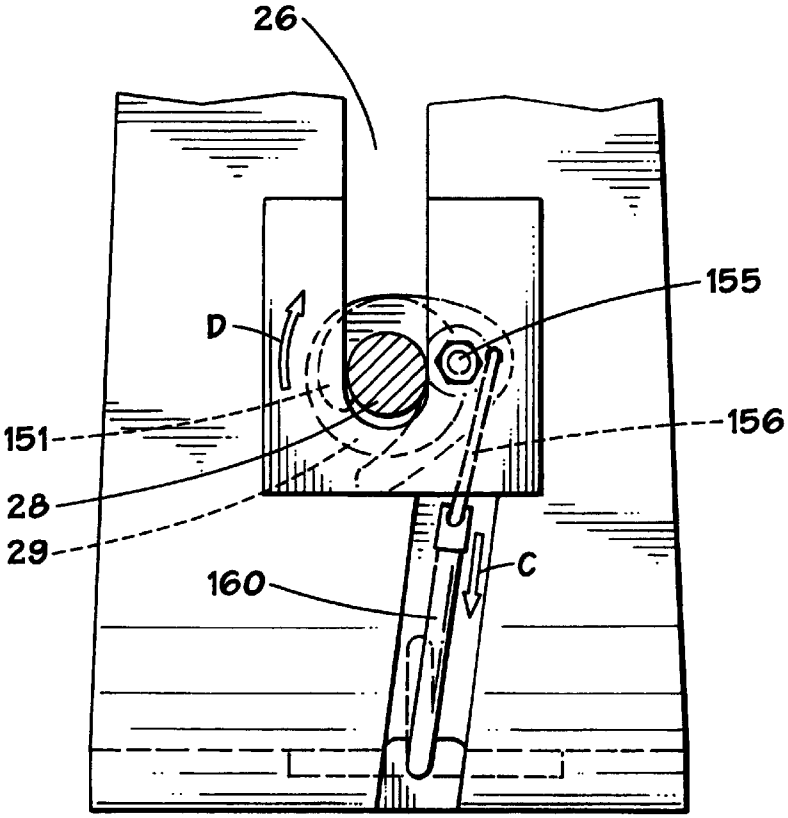
FIG. 6 is a side elevation view of the locking mechanism shown in FIG. 3 in the locked position.

Referring now to FIGS. 6 and 7, the release 160 for lock 150 is preferably coupled to the hook 151 by a connector rod 156, best shown in FIG. 4. The release 160 has side portions 161 and a raised portion 162, where H is the distance measured from the bottom of the side portions 161 to the top of the raised portion 162.

Figure 8:
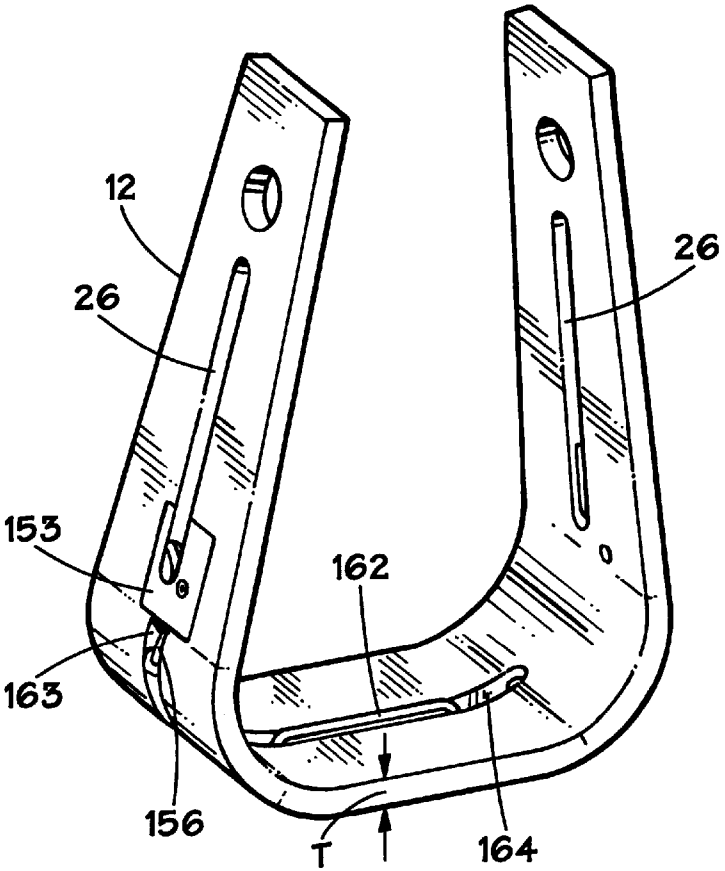
FIG. 8 is a top perspective view of the embodiment of the upper stirrup shown in FIG. 5.

Turning to FIG. 8, to accommodate the release 160, the upper stirrup 4 has two cut slots 163 disposed approximately on the edges of the bottom of the upper foot plate 14 and a horizontal slot 164 approximately in the center of the top of the upper foot plate 14. The upper foot plate 14 has a thickness T. The release 160 is disposed in the cut slots 163 and in the horizontal slot 164 on the upper foot plate 14. Preferably, the height H of the raised portion 162 is less than or equal to the thickness T of the upper foot plate 14. If the height H is greater than the thickness T of the upper foot plate 14, then, when the lower stirrup 6 is in the retracted position, the raised portion 162 protrudes from the surface of the upper foot plate 14.

Figure 9B:
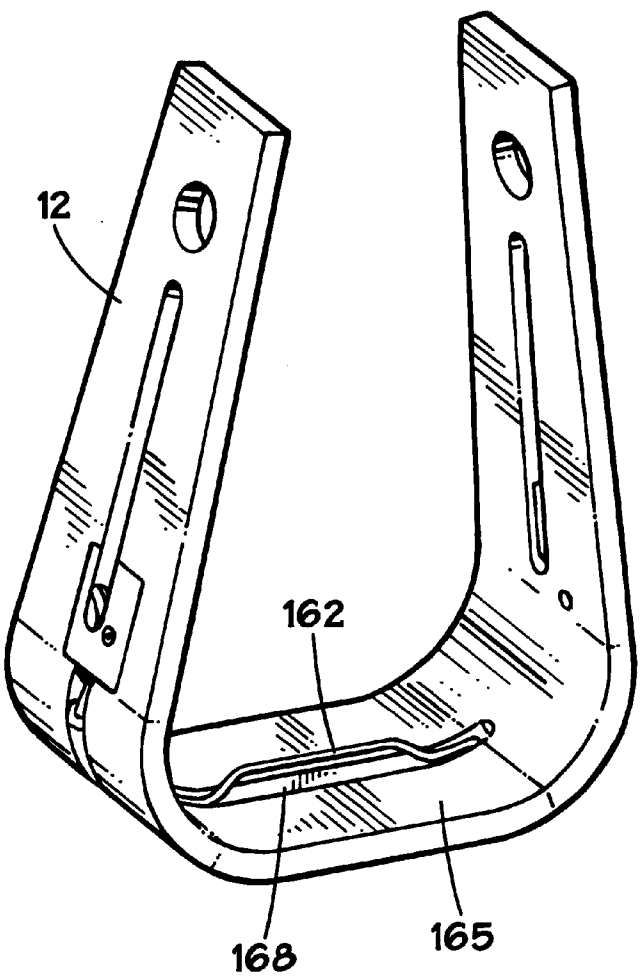
FIG. 9B is a top perspective view of an alternative embodiment of the release projecting through an upper tread pad.
Figure 9A:
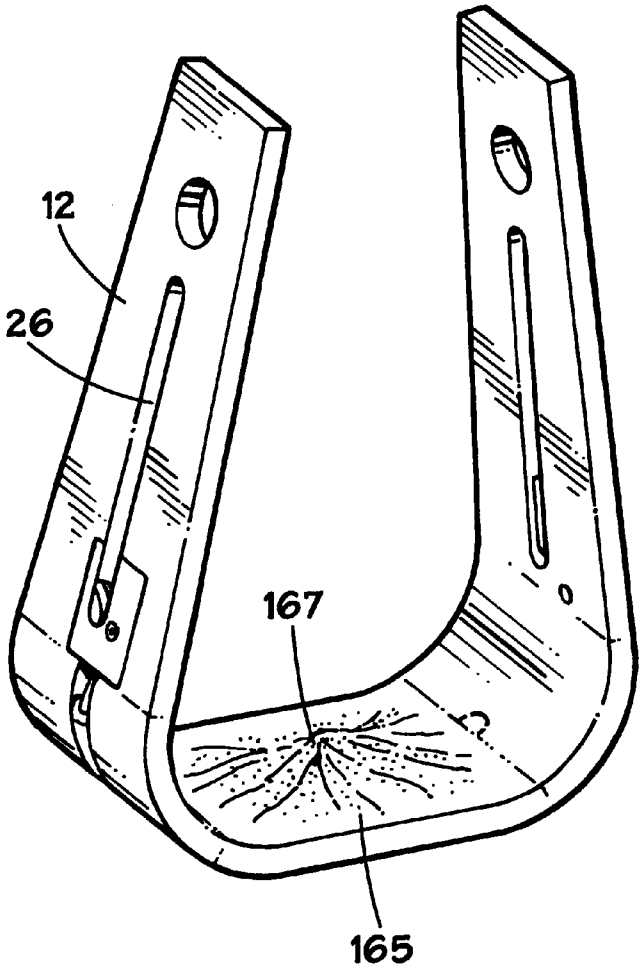
FIG. 9A is a top perspective view of an upper stirrup having an upper tread pad covering the release.

Referring to FIGS. 9A–B, upper and lower tread pads 165, 166 are disposed on the upper surface of the upper foot plate 14 and the lower surface of the lower foot plate 18. Referring particularly to FIG. 9A, the upper tread pad 165 forms a cavity 167 to house the raised portion 162 of the release 160 when the lower stirrup 6 is in the extended position. Cavity 167 may be formed in the material such as leather. Alternatively, the upper tread pad 165 has an opening 168, as shown in FIG. 9B, to allow the raised portion 162 of the release mechanism 160 to extend beyond the upper tread pad 165 when the lower stirrup 6 is in the extended position.

When a rider wishes to use the lower stirrup 6 to mount a horse, he or she can do so by manually moving the lower stirrup 6 from the retracted position to the extended position. Referring now to FIG. 3, when the lower stirrup 6 in the retracted position and is moved in the direction of the extended position as shown by arrow A, bolt 28 engages hook 151. As the lower stirrup 6 continues in the direction of arrow A, bolt 28 forces hook 151 to rotate in the direction of arrow B, resulting in hook 151 rotating to the locked position as shown in FIG. 6. The lower stirrup 6 is thereby locked in the extended position. The rotation of hook 151 also raises release 160 by means of connection rods 156 as shown in FIGS. 6, 9A and 9B.

With the lower stirrup 6 is locked in the extended position, the rider can more easily mount the horse by placing his/her foot in the lower stirrup 6, preferably on the lower foot plate 18. Once the rider has mounted the horse, the lower stirrup 6 can be retracted by engaging the release 160 with the foot to release lock 150. In the extended position, the raised portion 162 of the release 160 protrudes through the top surface of the upper foot plate 14. The lock 150 is released by the rider exerting downward force onto the protruding raised portion 162, thereby depressing the raised portion 162 of the release 160. This downward force moves the side portions 161 of the release 160 downward as shown by arrow C in FIG. 6. Consequently, the side portions 161 connected to rods 156 force the hook 151 to rotate in the direction of arrow D shown in FIG. 6 until the hook 151 has rotated far enough to allow the bolt 28, which is biased toward the upper stirrup 4 due to the retraction mechanism 50, to move up the longitudinal slot 26, placing the lower stirrup 6 in the retracted position.

Figure 10A:
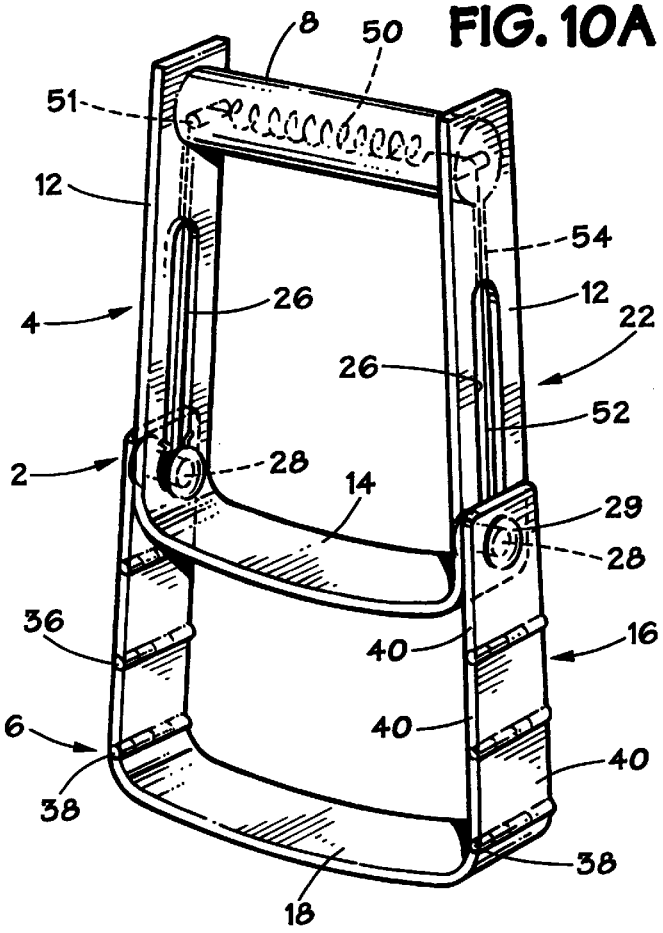
FIG. 10A is a perspective view of still another embodiment of the extendable stirrup showing a retraction mechanism and sliding attachment of the upper stirrup to the lower stirrup.
Figure 10D:
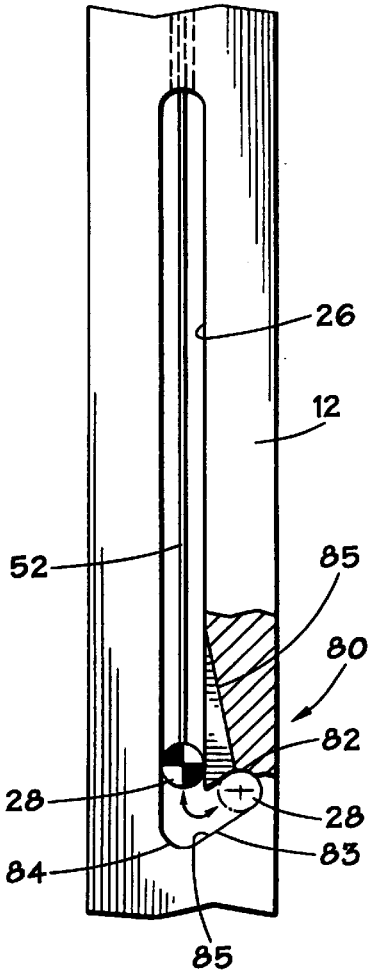
FIG. 10D is a partial side elevation view of the preferred embodiment of the lock showing a J-shaped extension of the longitudinal slot for locking the lower stirrup in the extended position, wherein a wire or cord is shown for retraction.
Figure 10B:
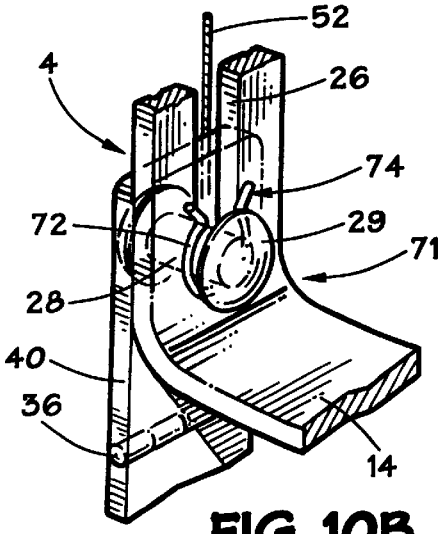
FIG. 10B is an enlarged view of the sliding attachment of FIG. 10A.

FIGS. 10A–B illustrate extendible stirrup 22, another embodiment similar to stirrup 2 of FIGS. 1 and 2, in which protrusions 28 mounted near the top of the lower side members 16 extend into longitudinal slots 26 of the upper side members 12. In the particular embodiment illustrated, protrusions 28 are bolts, but the invention is not so limited. As detailed in FIG. 10B, bolt heads 29 slidingly engage the interior side of upper sides members 12 to maintain the attachment of upper and lower stirrups 4, 6.

Referring still to FIGS. 10A–B, the lower side members 16 may include a plurality of plates 40 connected by transverse hinges 36, 38 so that the lower stirrup 6 readjusts to the varying width between upper sides 4 of the upper stirrup 4 during sliding movement. In the example shown in FIG. 10A, each lower side member 16 includes three flat plates 40 joined by transverse hinges 36. One hinge 38 connects the lowermost adjacent plate 40 on each side 16 to the lower foot plate 18. Hinges 36, 38 enable the lower side members 16 to flex around the upper foot plate 14 of the upper stirrup 4 while lower side members 16 are sliding on upper side members 12. An alternate embodiment includes the use flexible straps (not shown) to form the lower side members 16. The flexible straps may be constructed with a variety of materials such as nylon, leather, cloth, or flexible plastic.

In FIG. 10A, the retraction mechanism 50 includes an elastic material or a torsion spring 57 passing the cord or wire 52, e.g., a coated steel cable or a nylon filament, over a roller 51 and then through a longitudinal hole 54 in the upper side member 12. Each end of the cord or wire 52 is attached to the bolts 28 or to the top of the lower side members 16. The retraction mechanism 50 keeps the lower stirrup 6 under a tension, biasing it to the retracted position nested against the upper stirrup 4.

Figure 10C:
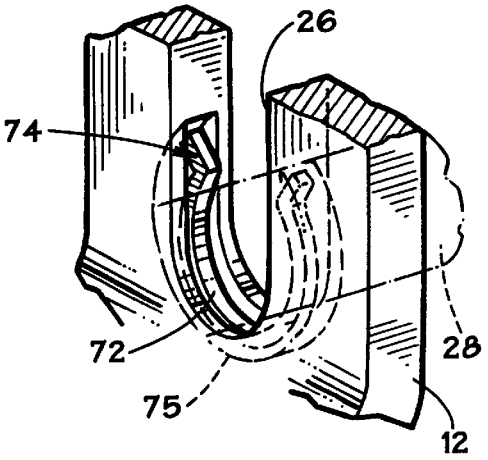
FIG. 10C is a perspective view of the wire keeper for a bolt in the sliding attachment shown in FIG. 10A.

FIG. 10B illustrates one embodiment of a lock 71 for locking the lower stirrup 6 in the extended position. Lock 71 includes a spring-like wire keeper 72 mounted in the lower end of slot 26 in upper side member 12. The wire keeper 72 has jaws 74 that open upwardly for receiving the shaft of protrusion 28. Referring now to FIG. 10C, one method for attaching the wire keeper 72 to the bottom of the longitudinal slot 26 is inserting the wire keeper 72 into a recess 75. When the rider (not shown) pulls down to extend the lower stirrup 6, the shaft of the bolt 28 on lower side member 16 is forced through the jaws 74 of wire keeper 72 causing the jaws 74 to open, thereby allowing the bolt 28 to pass into the wire keeper 72. The jaws 74 then reclose grasping the shaft of the bolt 28, locking the lower stirrup 6 in the extended position while the rider lifts his foot up to the lower foot plate 18. During mounting, the additional downward pressure on the lower foot plate 18, typically due to the rider's weight, forces the shaft of bolt 28 downward against the bottom of wirekeeper 72 causing the jaws 74 to separate and reopen wire keeper 72. Upon releasing the rider's weight, the retraction mechanism 50 applies an upward force on bolts 28 causing the bolts 28 to pass back through the wire keeper's jaws 74 and releasing the lower stirrup 6. The rider's weight is automatically removed from the lower stirrup when the rider suddenly releases pressure on the lower foot plate 18 by removing his or her foot therefrom and raising the foot to the upper foot plate 14 of the upper stirrup 4 to take the riding position (not shown). The lock 71 enables the rider to lock the lower stirrup 6 of FIGS. 10A–B in the fully extended position while he or she raises his or her foot onto the lower foot plate 18. It should be appreciated that the wire keeper 72 may take a variety of forms known to those of ordinary skill in the art to provide the above-described operation.

Turning to FIG. 10D, the J-shaped slot 82 is shown with the cord or wire 52 as the retraction mechanism 50. If using a cord or wire 55, the region between the longitudinal slots 26 and J-shaped slots 83 may include a groove 85 to receive the cord or wire 55 so that tension therefrom does not pull the bolt 28 out of the J-shaped slot 82. The groove 85 may pass through the center of the width of the upper side member 12 or be asymmetrically disposed with respect to the width of the upper side member 12. In one embodiment, the groove 85 extends along about one-third of the length of the longitudinal slot 26. In the preferred embodiment, as shown in FIG. 2B, the J-shaped slot 82 does not include groove 85 because elastomer cord 55 attaches to T-bolt 56 on the top of upper sides 12.

Referring now to FIG. 11A, another embodiment of the extendible stirrup is shown. Extendible stirrup 24 includes protrusions 30 on the lower side members 16 which are received into longitudinal slots 26 of the upper side members 12 to guide the sliding motion of the lower stirrup 6 on upper stirrup 4. Extendible stirrup 24 also includes metal catch 33. When the lower stirrup 6 is in the extended position, the catch 33 engages hole 39. Hole 39 and catch 33 act as a stop to limit the downward movement of lower stirrup 6 and prevent the upper stirrup 4 and the lower stirrup 6 from separating completely. In the particular embodiment illustrated, the protrusions are track bars 30, although the invention is not so limited. A thin bolt 31 passes through a longitudinal slot 34 of the track bar 30 to keep the upper and lower stirrups 4, 6 attached. To increase the smoothness of the sliding motion of the lower stirrup 6, the outer diameter of the protrusions 30 may closely match the width of the longitudinal slots 26.

Still referring to FIG. 11A, the preferred retraction mechanism 50 includes two coil springs 60 maintaining wires 52 under tension. Each coil spring 60 is rotatably mounted within the hollow crossbar 8 and positioned so that the cord or wire 52 feeds directly to lower side members 16 without need for the roller 51 as shown in FIG. 10A. Each wire 52 connects one of the lower side members 16 to one of the coil springs 60. As the lower stirrup 6 is extended, one end of the coil spring remains fixed while the other end attached to cord or wire 52 is wound up around arbor 64 as coil spring 60 is rotated. On release of foot pressure on the lower foot plate 18, coil springs 60 rewind the wires 52 retracting the lower stirrup 6 to a position nested against the upper stirrup 4, as shown in FIG. 1.

Figure 12A:
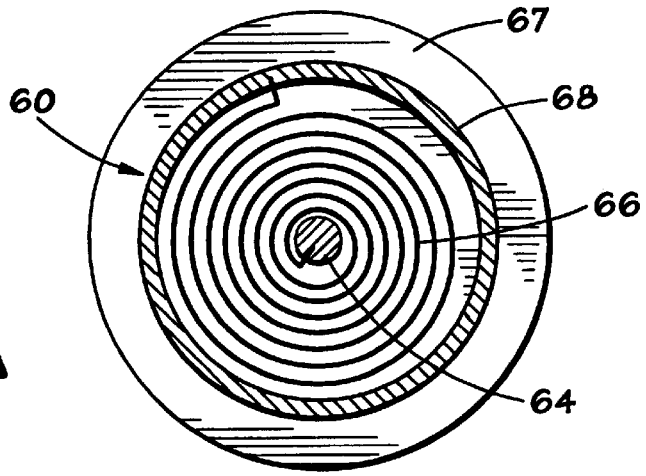
FIG. 12A is an enlarged view of the retraction mechanism of FIG. 11A showing a coil spring for retracting the lower stirrup.
Figure 12B:
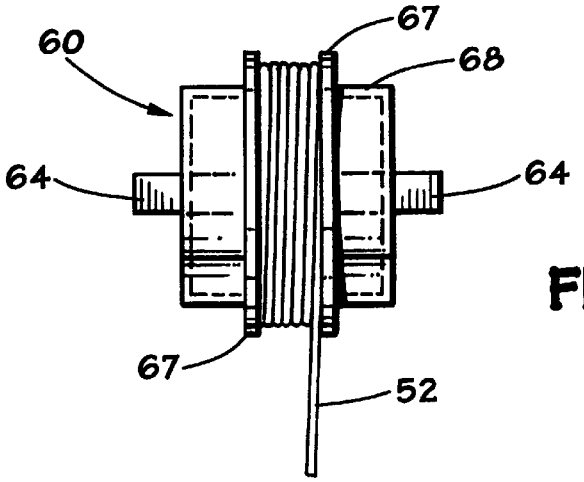
FIG. 12B is a side elevation view of the coil spring of FIG. 12A.
Figure 12C:
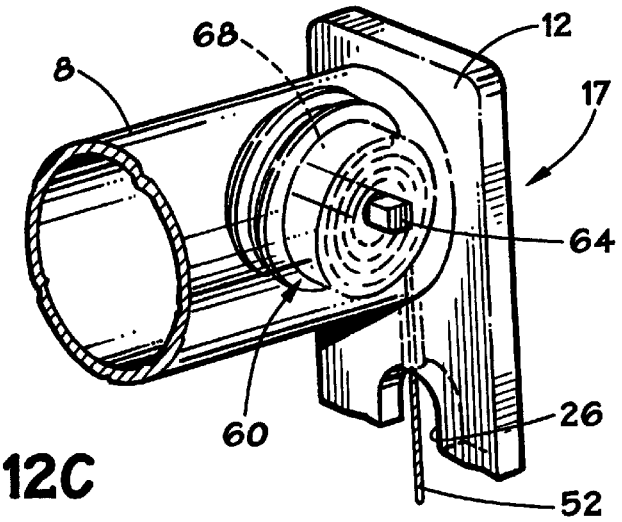
FIG. 12C is a perspective view of the retraction mechanism of FIGS. 12A and 12B employing the coil spring.

FIGS. 12A–12C show one of the coil springs 60 of FIG. 11A in more detail. The coil spring 60 includes a central arbor 64, a coiled strip of spring metal 66, and a circular drum 68. One end of the coiled strip of spring metal 66 attaches to the central arbor 64 and the other end attaches to the circular drum 68. The central arbor 64 is rigidly fixed to the interior of the crossbar 8. The circular drum 68 is free to rotate under the tension produced by the coiled strip of spring metal 66 causing the spring metal 66 to coil tightly around drum 68. Upon release of the lock, the spring metal 66 uncoils thereby rewinding the wire 52 of FIGS. 10A–11A. The coil spring 60 keeps the wire 52 under a substantially constant tension of approximately 6.7 to 11.1 newtons (48 to 80 foot pounds per second squared) at intermediate positions between the retracted and fully extended positions of lower stirrup 6. One end of the wire 52 attaches to and wraps around the drum 68 between the two guard flanges 67. The other end of the wire 52 couples to the lower stirrup 6 or to the bolt 28. Each side member 16 of the lower stirrup 6 couples to one of the wires 52, and each of the wires 52 connects to a separate one of the coil springs 60.

Referring now to FIGS. 10A–12C, the crossbar 8 preferably has a round or a U-shaped cross-section. One embodiment includes a round crossbar 8 with an inside diameter of about 2.54 centimeters (cm) (1.0 inch). The wire 52 is a steel cable of less than about 0.16 cm (1/16 inches) diameter, and the drum 68 is made of metal or plastic and has a diameter of about a 1.3 cm (0.5 inches) and a width of about 1.9 cm (0.75 inches). The drum 68 has two side guard flanges 67, which are about 1.9 cm high (0.75 inches). The coiled strip of spring metal 66 is stainless steel and has a width of about 0.63 cm (0.25 inches) and a thickness sufficient to provide an adequate retraction force. The central arbor 64 may be steel or plastic and has a width of about 0.32 cm (0.125 inches). The ends of the central arbor 64 may be square so that arbor 64 seats non-rotatably into slots (not shown) in the sides of the crossbar 8 or the arbor 64 may be affixed non-rotatably to the crossbar 8 in another manner. The above-described embodiment for the retraction mechanism 50 enables extending the lower stirrup 6 by about 7.6 to 15.2 cm (3 to 6 inches) under a substantially constant return force of about 6.7 to 11.1 newtons (48 to 80 foot pounds per second squared).

Figure 13D:
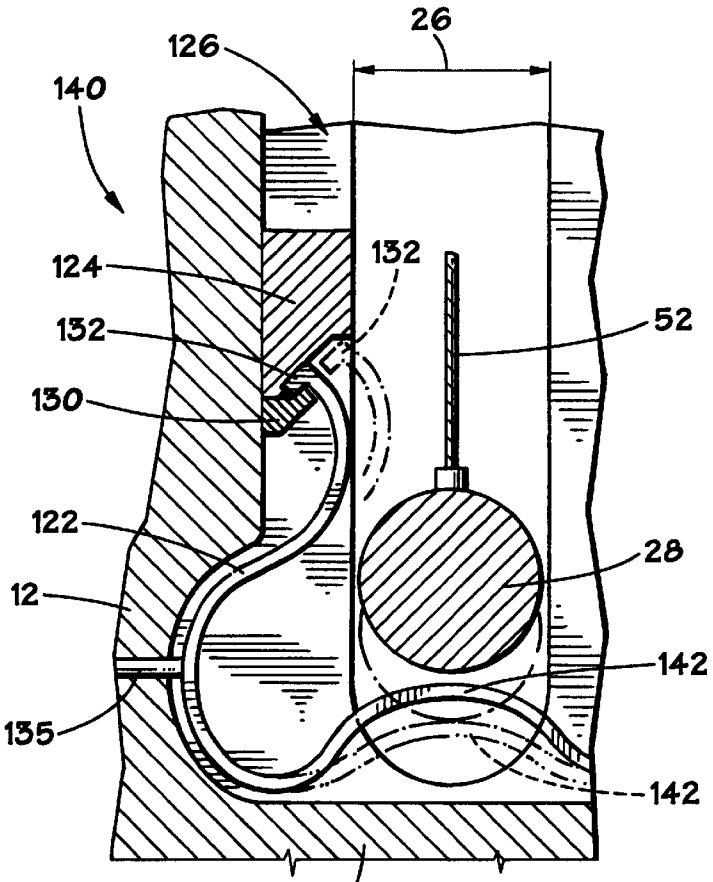
FIG. 13D is a cross-sectional view of the lock of FIGS. 13B–13C showing the spring catch locking the lower stirrup in the extended position and releasing the lower stirrup from the locked position.

Referring now to FIGS. 13A–13D, still another lock 120 for locking the lower stirrup 6 is shown in the extended position. Referring to FIGS. 13B and 13D, the lock 120 includes a flexible spring catch 122 rotatably mounted on each upper side member 12, an arm 124 rigidly fixed to each lower side member 16, and bolts 28. Bolts 28 pass through holes in the lower side members 16 and through the longitudinal slots 26 of the upper side members 12. FIG. 13A is a perspective view of a portion 125 of the upper side member 12 showing a longitudinal enlarged groove 126 positioned along the exterior face of longitudinal slot 26. Each bolt 28 slidably joins the upper and lower side members 12, 16 by passing through the slot 26. The arms 124 extend into the enlarged grooves 126 in a manner that enables a sliding connection between the upper and lower side members 12, 16.

FIGS. 13B illustrates the lock 120 locked in the extended position. As the rider pulls the lower stirrup 6 downward, a triangular extension 130 of the arm 124 pushes the ends 132 of the spring catch 122 inward (see FIG. 13D). When the triangular extension 130 slides past the ends 132, the spring catch 122 re-expands pushing the ends 132 over the triangular extensions 130. When the ends 132 of the spring catch 122 are caught on top of the triangular extensions 130, the lower stirrup 6 is locked in the extended position.

Figure 13C:
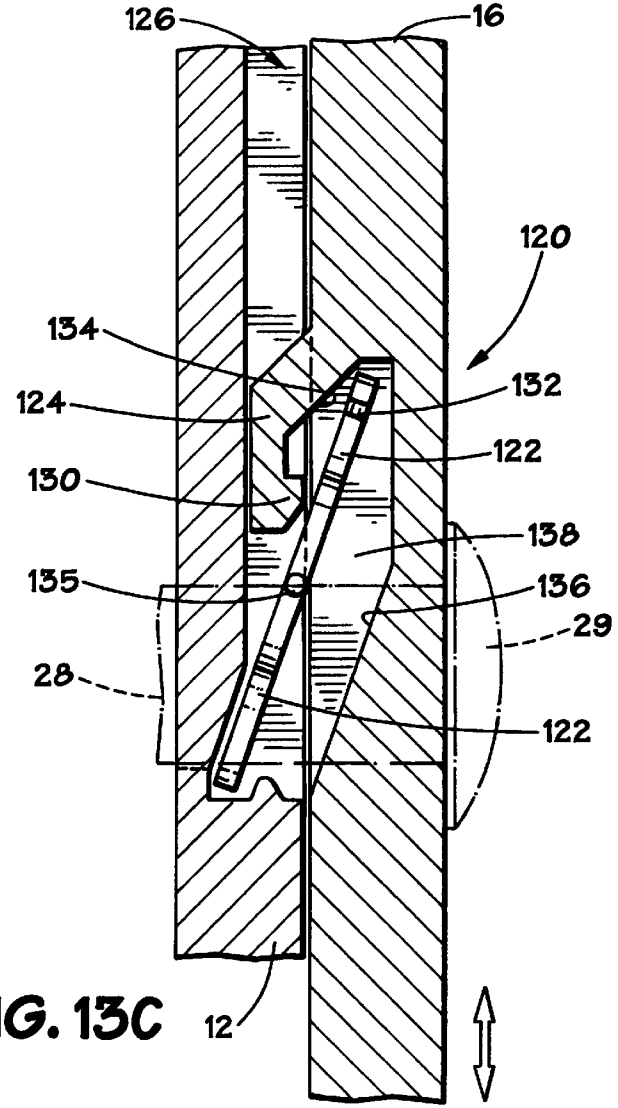
FIG. 13C is a cross-sectional view of the lock of FIG. 13B showing the lower stirrup released from the locked configuration.

FIG. 13C illustrates the lock 120 released from the locked configuration of FIG. 13B. The weight of the rider's foot on the lower foot plate 18 pushes the lower side member 16 further downward. During the downward motion, a diagonal surface 134 on the arm 124 tilts the spring catch 122 around a pivot axis 135 and away from the longitudinal direction. In the tilted position, the ends 132 of the spring catch 122 are no longer caught on the triangular extensions 130 of the arms 124. When the rider removes his weight from the lower foot plate 18, the retraction mechanism 50 retracts the lower stirrup 6 without catching the ends 132 of the spring catch 122 on the triangular extensions 130. As the lower side members 16 move upward, a diagonal wall 136 of the cavity 138 tilts the spring catch 122 back to the vertical direction thereby readying the spring catch 122 to lock the next time that the rider extends lower stirrup 6.

FIG. 13D shows the outer face of the upper side member 12 and of the portion of the arm 124 that enters into the longitudinal groove 126 along the outer face of the upper side member 12. FIG. 13D shows how one of the ends 132 of the spring catch 122 catches over the triangular extension 130 of the arm 124. As the lower side member 16 moves down further, the bolt 28 compresses a bump 142 on the spring catch 122 thereby causing the ends 132 to be pushed inward, i.e., off the triangular extensions 132. The inward motion of the ends 132 facilitates the tilting the spring catch 122 with the diagonal surface 134 as the downward movement of the side member 16 continues.

A cam lock (not shown) for coil springs 60 shown in FIGS. 11A and 12A may also be used as yet another lock for locking the lower stirrup 6 in the extended position. The cam lock reversibly locks the coil spring 60 at a fixed internal tension when external forces on the wire 52 release at a fixed extension. Subsequently, pulling on the wire 52 releases the cam lock allowing the lower stirrup 6 to extend or retract. Such cam locks are well known in the art and may, for example, include a ratcheting device (not shown).

The invention is intended to also cover other devices for locking the lower stirrup 6 in the extended position. These devices may include one or more hooks, catches, or clips (all not shown) known to those of ordinary skill in the art. These devices can be positioned at the base of the slots 26 of FIGS. 10A and 11A to grasp/release the bolt head 29 or the catch 33 thereby locking/releasing the lower stirrup 6 by techniques known to those of ordinary skill in the art.

The bolt 28 with the wire keeper 72, the bolt 28 with the J-shaped extension slot 82, the lock 120, and the lock 150 form alternate means for locking the lower stirrup 6 in the extended position. The cam locking mechanisms for the coil springs 60 form another means for locking the lower stirrup 6 in the extended position.

The above-described hollow and matching cross-section upper and lower side members 12, 16, the slots 26 and bolts 28, and the slots 26 and track bars 30 form alternate means for slidably 20 connecting the upper and lower stirrups 4, 6.

The embodiments of the present invention previously described are particularly applicable for use with western style saddles although they are not limited to such use. The present invention may also be used with an English style saddle.

Figure 15:
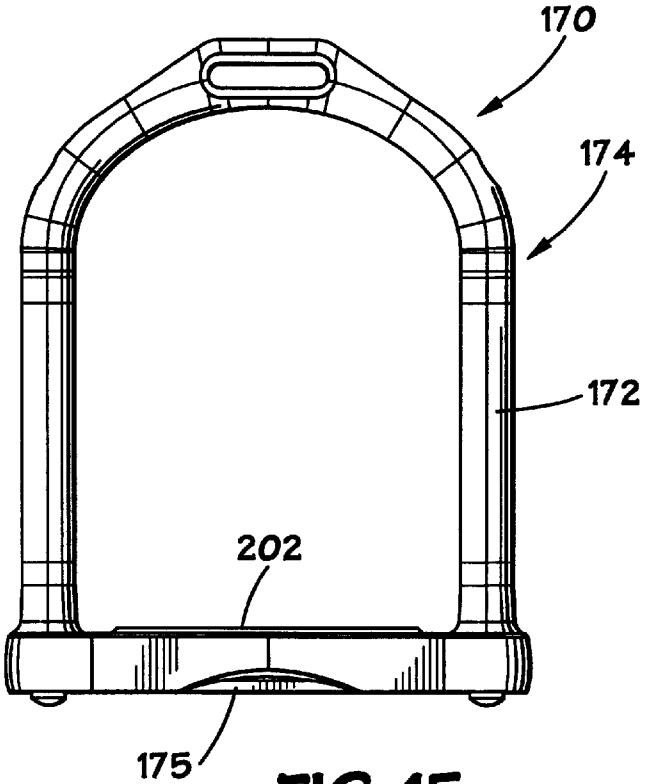
FIG. 15 is an elevated view of the English stirrup of FIG. 14 in the retracted position.
Figure 14:
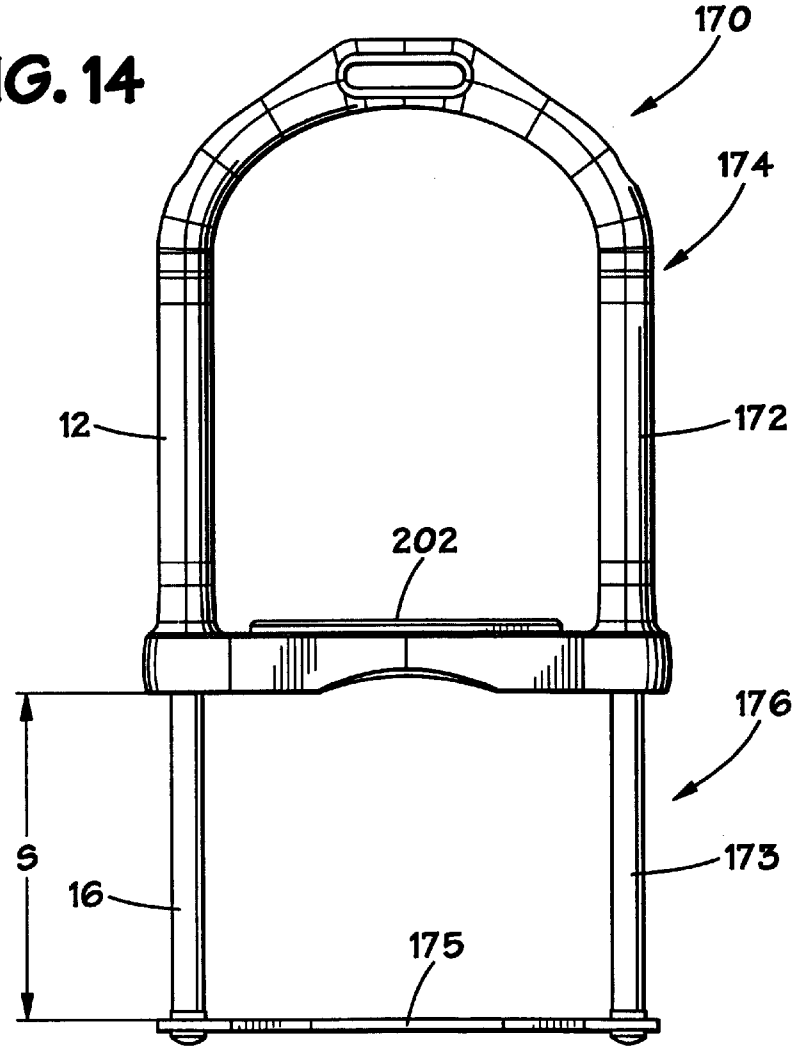
FIG. 14 is an elevated view of still another embodiment of the extendable stirrup, particularly directed for use with an English saddle, in the extended position.

Referring now to FIGS. 14 through 19, there is shown an embodiment of the extendable stirrup 170, commonly referred to as the "English Stirrup," for use with an English saddle. FIG. 14 illustrates extendable stirrup 170 in the extended position, while FIG. 15 shows the extendable stirrup 170 in the retracted position. Referring particularly to FIGS. 14 and 15, the extendable stirrup 170 has upper and lower stirrups 174, 176. Upper stirrup 174 has hollow upper side members 172 sized to receive the lower side members 173 of lower stirrup 174 whose cross section is dimensioned to be slidingly received within the hollow interiors of upper side members 172. The hollow interiors of the upper side members 172 guide the sliding motion of the lower side members 173 between the extended and retracted positions. The cross-sections of the upper and lower side members 172, 173 may take a variety of matching shapes, e.g., circular, oval, square, triangular, and rectangular. The upper stirrup 174 has an upper foot plate 171, while the lower stirrup 176 has a lower foot plate 175. The step height S (i.e., the distance between the upper and lower foot plates 171, 175 when the lower stirrup 176 is in the extended position) is preferably between four and five inches in height (10.16–12.7 cm). The ideal step height S is between four and a quarter (10.795 cm) and four and one-half inches (11.43 cm). It should be appreciated that the height of the horse does not determine the extension height S of the extendable stirrup which remains substantially the same without regard to the height of the animal. The height of the upper or primary stirrup on the saddle is most important since that height determines the rider's ability to swing his or her leg over the saddle and the back of the horse. A stirrup which is low to the ground has little value if the rider cannot place his or her leg over the saddle into the other stirrup.

Figure 16:
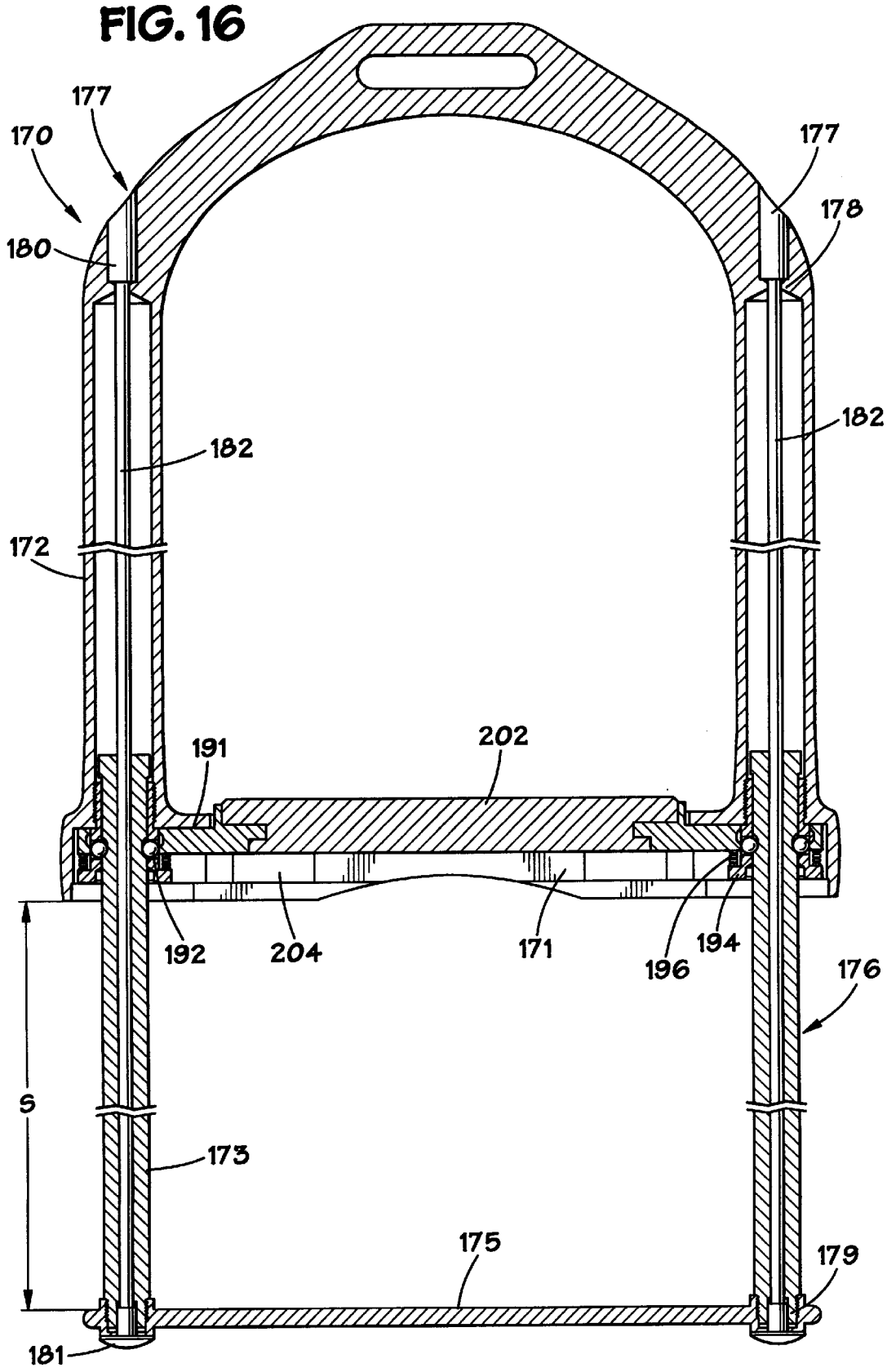
FIG. 16 is a cross-sectional elevation view of the extendable stirrup of FIG. 14 in the extended position.

Referring now to FIG. 16, the extendible stirrup 170 houses a retraction mechanism 177. The retraction mechanism 177 may use an elastic material, such as a cable, a wire, a cord, or any type of elastic line 182. Embodiments of the retraction mechanism 177 using an elastic material pass the cord or line 182 through the upper and lower side members 172, 173 and connect the elastic material 182 to the upper end 178 of the upper side member and the lower end 179 of the lower side member.

As shown in FIG. 16, one embodiment of the retraction mechanism 177 uses an elastic material formed such that the upper and lower ends 180, 181 of the line or cord 182 have a greater diameter than the rest of the line or cord 182 forming a plug or stopper at each end. In this manner, the plug or stopper is used to connect and retain the ends 180, 181 of line or cord 182 to upper and lower side members 172, 173. This embodiment is not limited to this particular retraction mechanism. Other embodiments of the retraction mechanism 177 may include a coupling or insert that grips the ends 180 and 181 of the elastic material and locks the end of the elastic material against an end of the upper and lower side members 172, 173. Such embodiments permit the use of an elastic cord or line formed with a uniform diameter. Still other embodiments of the retraction mechanism may be implemented, with springs or other materials to provide the necessary tension force, by those skilled in the art with the benefit of this disclosure.

The retraction mechanism 177 keeps the lower stirrup 176 under tension, biasing its return to the retracted position nested against the upper stirrup 174 as shown in FIG. 16. When the rider desires to mount the horse, he or she manually extends the lower stirrup 176 until the lower stirrup 176 locks into the extended or mounting position. Once locked in this position, the lower stirrup 176 will remain in this position by a lock 190 until the rider mounts the horse.

Figure 17:
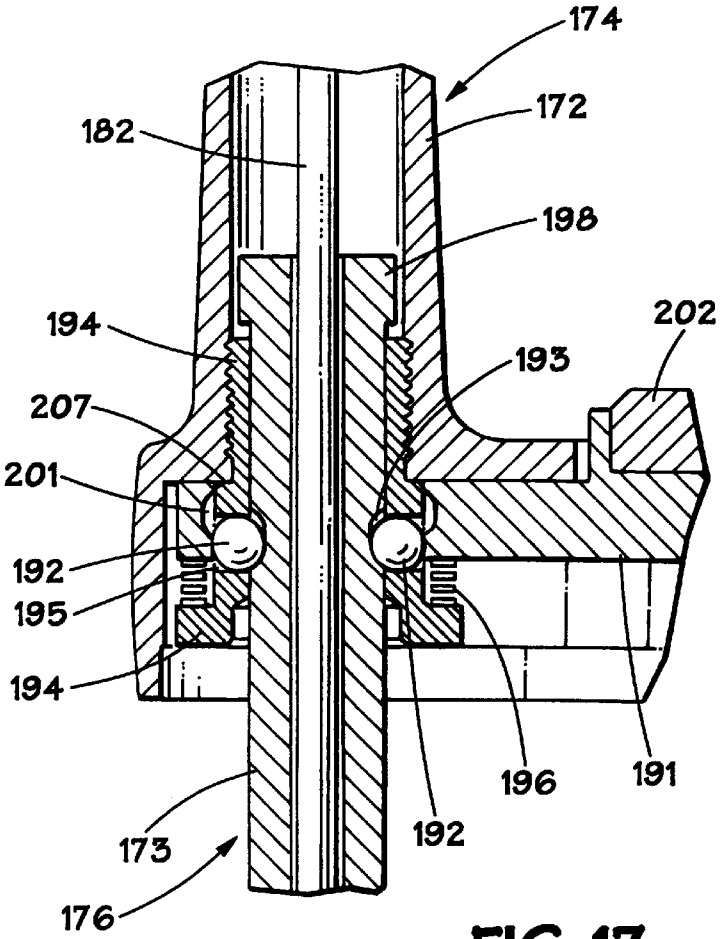
FIG. 17 is an enlarged cross-sectional view of another embodiment for a lock and release mechanism for the English stirrup shown in FIG. 14 while in the extended position.

Referring now to FIGS. 16 and 17, the lock 190 works in unison with an actuator plate 191 reciprocably disposed within a cage 204 formed by upper foot plate 171. Actuator plate 191 extends across upper foot plate 171. With the lower stirrup 176 in the extended position, the elastic material of the retraction mechanism 177 is extended and is acting on the lower stirrup 176, biasing the lower stirrup 176 to pull it back into the bores of upper side members 174. This retracting action is prevented by the interference of bearings 192 seated in a grooves 193 around the circumference of the lower side members 176. The lower side members 176 are restrained from moving in the axial direction of the lower side members' 176 shaft by holes 195 located in a bushing 194 mounted in an aperture 207 passing through each end of actuator plate 191.

The holes 195 run perpendicular to the central axis of the bushing 194. In this embodiment, forces generated by the elastic material and exerted on the bearings 192, by the geometry of the grooves 193, push the bearings 192 radially outward with respect to the centerline of the lower side members 173 into holes 195. The position of the actuator plate 191 prevents the outward motion of the bearings 192. The actuator plate 191 is held in place within cage 204 by a spring 196 disposed between it and a flange 197 on bushing 194. The lower end of bushing 194 engages the lower side of cage 204 and plate 191 engages the upper side of cage 204 in the extended position.

When the rider places his/her weight on the lower stirrup 176, the lower stirrup 176 is prevented from detachment from the upper stirrup 174 by a flange 198 at the upper end of the lower side member 176. The flange 198 stops against the bushings 194. This configuration transfers the weight of the rider to the bushings 194 instead of the bearings 192.

Figure 19:
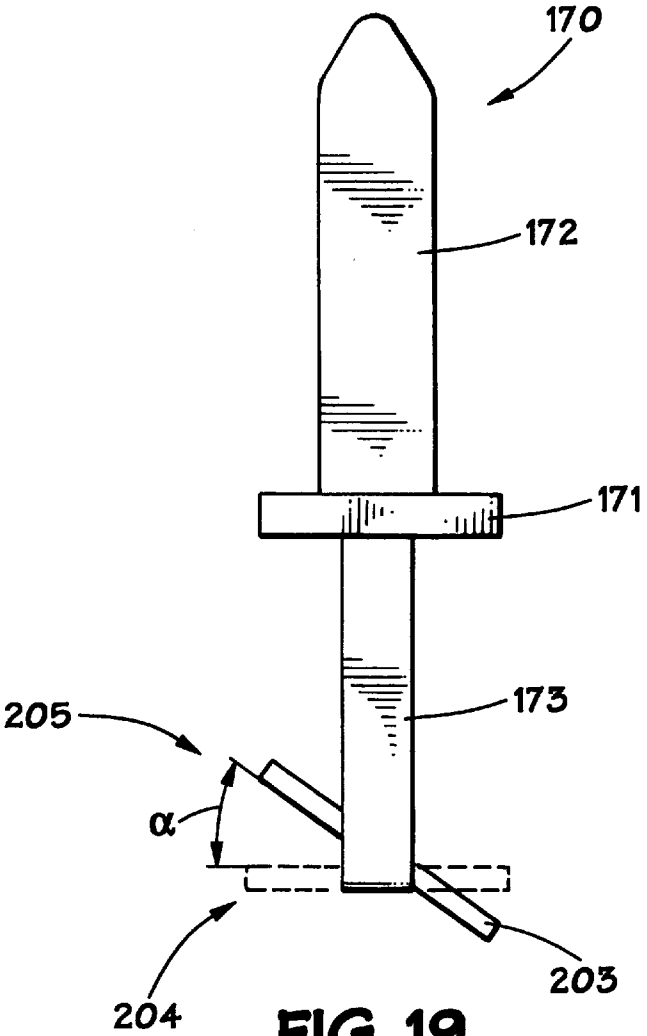
FIG. 19 is a side elevation view of another embodiment of the extendable stirrup with a lower pivoting foot plate.
Figure 20:
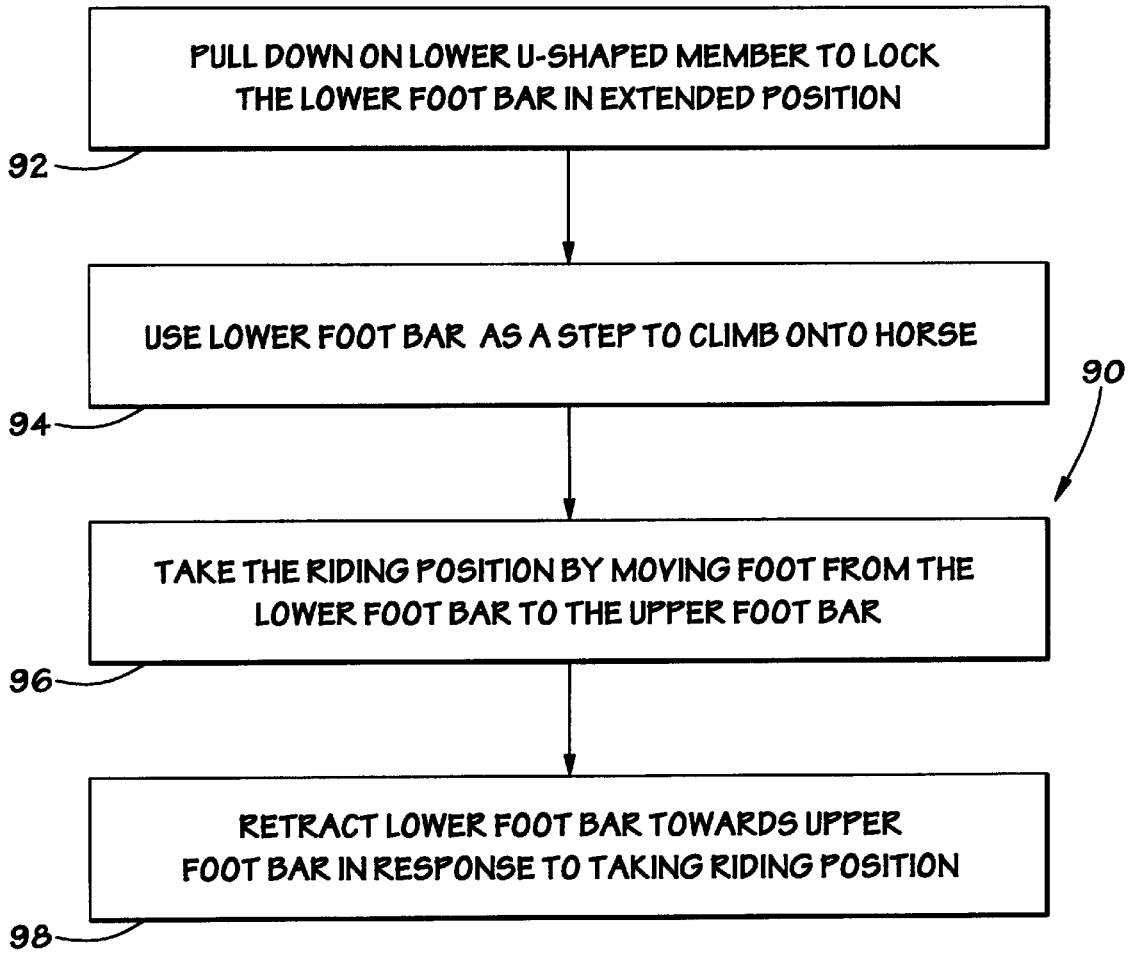
FIG. 20 is a flowchart illustrating one method of using the extendable stirrups of the present invention.

The lower stirrup 176 can also be configured with a pivoting lower foot plate 203 shown in FIG. 20, to provide greater mounting ease. The pivoting foot plate 203 has a limited range of motion, moving from a first position 204 to a second position 205. This limited range ensures that the pivoting foot plate 203 does not injure the rider by rotating too far either towards the rider or away from the rider. Preferably, the pivoting foot plate 203 pivots toward the rider at an angle a being approximately 35°–40° as shown in FIG. 19.

Figure 18:
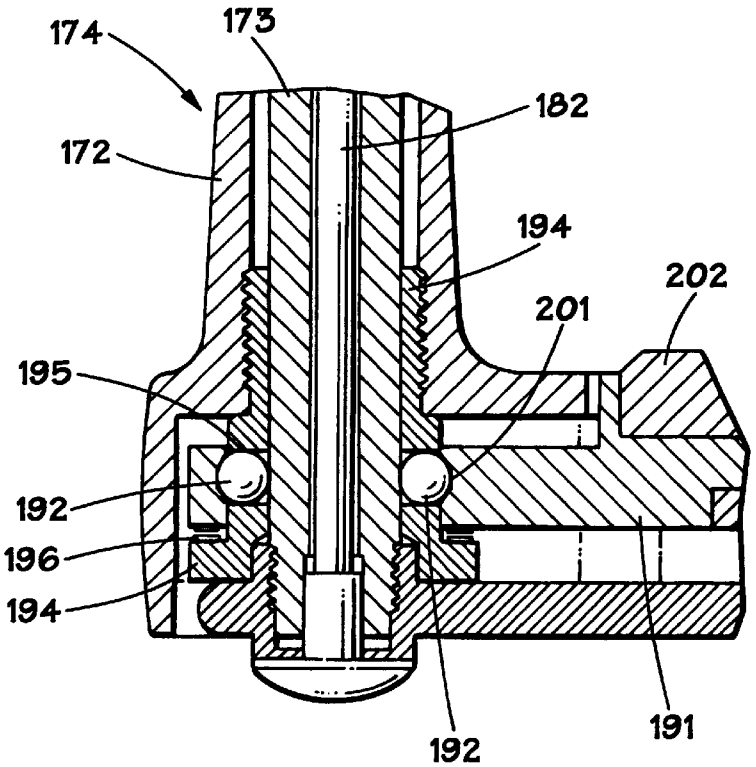
FIG. 18 is an enlarged cross-sectional view of the lock and release mechanism of FIG. 1 while in the retracted position.

Turning now to FIGS. 16 and 18, after the rider mounts the horse, there is no longer any need for the lower stirrup 176 to remain in the extended position. The rider can retract the lower stirrup 176 into the upper stirrup 174 so that the upper and lower stirrups 174, 176 combine to form a typical riding stirrup. In this embodiment of the invention, when the rider places his or her foot into the upper stirrup 174 and pushes down on a rubber tread 202 mounted on actuator plate 191, the lower stirrup 176 automatically retracts. This action is accomplished with a release mechanism 200 that aligns a groove 201 located on the inside diameter of the actuator plate 191 with the centerline of the holes 195 in the bushing 194 used to pilot the bearings 192. In this position, the actuator plate 191 no longer restrains the bearings 192 and they move outward from the centerline into holes 195, and the lower side members 176 retract into the upper side members 174.

Once the lower side members 176 begin to retract and their grooves 193 clear the bearings 192, the bearings 192 can no longer move inward (toward line or chord 182) since they are now locked by side members 176. In this position, the actuator plate 191 is prevented from moving upward by the bearings 192 and the groove 201. In this embodiment, the actuator plate 191 is configured such that when it is locked in this position, only the actuator foot pad 202 is exposed above the upper foot plate 171 of the upper stirrup 174. The lower stirrup 176 is intended to stay in this retracted position while the individual is riding the horse.

When the rider is ready to mount the horse again, he or she must overcome the preload forces of the elastic material or other retraction mechanism and pull the lower stirrup 176 down to its fully extended and locked position. The lower stirrup 176 automatically locks into the open or extended position, as described above. Forces generated by springs 196 and exerted on the bearings 192 by the grooves 201 on the pilot inside diameter of the actuator plate 191, push the bearings 192 radially inward with respect to the centerline of the lower side members 176. When the lower stirrup 176 is fully extended and the grooves 193 on the lower side members 176 are in line with the centerline of the holes 195 in the bushing 194, the bearings 192 will move inward and the actuator plate 191 will move upward. The actuator plate 191 will stay in this position until the rider's foot depresses the actuator foot pad 202 as previously described.

It can be seen that the extendable stirrup is balanced in that the retraction mechanism, locks, and releases operate on both side of the stirrup and not just on one side. Further the extendable stirrups are rigid for supporting the rider.

FIG. 20 is a flowchart of steps of a method 90, performed by a rider (not shown), for using the extendible stirrup 2. It should be appreciated that this method may also be used with the other embodiments of the stirrup. At block 92, the rider manually pulls down on the lower stirrup 6 to lock the lower foot plate 18 in the extended position, i.e., a position in which the lower and upper foot plates 14, 18 are not adjacent. The rider locks the lower foot plate 18 by using one of the locks previously described such as the wire keeper 72, the J-shaped slot extension 82, the cam lock for the coil springs 60, or the lock 177 to lock the lower stirrup 6 in the extended position. At block 94, the rider mounts the horse or other riding horse (not shown) using the lower foot plate 18 as a step. In one or more of the embodiments of the release 160, the lock 150 is automatically and simultaneously released. At block 96, the rider takes the riding position by moving his or her foot from the lower foot plate 18 to the upper foot plate 14, i.e., the riding foot plate. Placing weight on the upper stirrup in certain embodiments will automatically release the lock. At block 98, the retraction mechanism 50 retracts the lower foot plate 18 to a position substantially adjacent the upper foot plate 14 in response to the rider taking his or her foot off the lower foot plate 18.

Figure 21B:
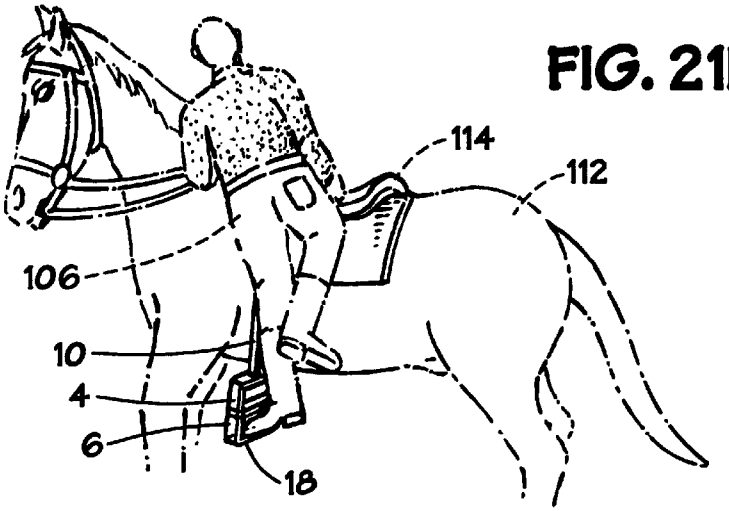
FIG. 21B illustrates a rider mounting the horse using the extended stirrup.
Figure 21C:
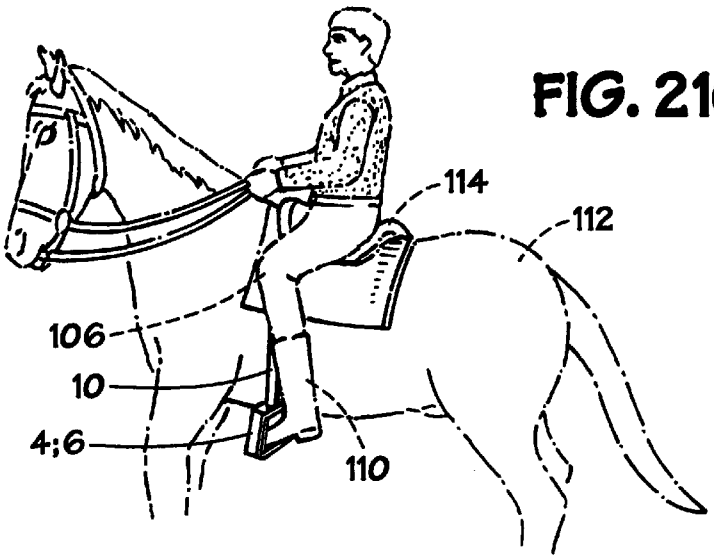
FIG. 21C illustrates a rider riding the horse having released the stirrup now in the retracted position.
Figure 21A:
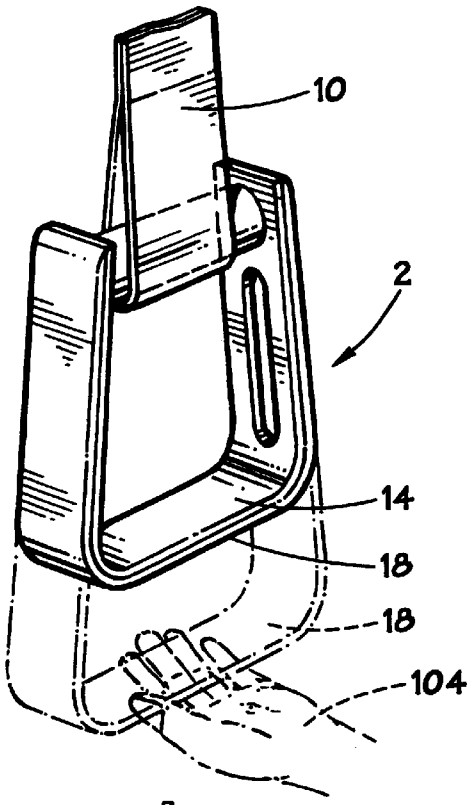
FIG. 21A illustrates manually pulling the lower stirrup to the extended position.

FIGS. 21A, 21B, and 21C illustrate the operation of extendible stirrup 2 for mounting a horse. Again, it should be appreciated that this operation may also be used with the other embodiments of the stirrup. FIG. 21A illustrates a rider 106 using his or her hand 104 to lock the extendible stirrup 2 in the extended position. FIG. 21B shows the rider 106 placing his or her boot 110 on the lower foot plate 18 to aid in mounting the horse 112. The stirrup strap 10 transmits the weight of the rider 106 from the extendible stirrup 2 to the riding saddle 114. The stirrup strap 10 attaches the extendible stirrup 2 to the riding saddle 114 on the mounting side, and a second stirrup strap attaches an ordinary stirrup (both not shown) to the riding saddle 114 on the other side. FIG. 21C shows the rider 106 after placing his or her boot 110 on the upper foot plate 14, i.e., to take the riding position. In certain embodiments of the extendable stirrup disclosed herein, the lower stirrup automatically retracts and nests against the upper stirrup in response to the rider 106 removing foot pressure from the lower stirrup and remains retracted during riding. In other embodiments, the lower stirrup retracts and nests against the upper stirrup when a trigger is activated and remains retracted during the riding.

The extendible stirrup of the present invention is not limited to use for mounting horses. Rather, the invention may be used on other riding animals such as donkeys, mules, llamas, alpacas, bulls, and elephants. The invention may also be used to mount mechanical riding machines such as an electric bull machine. The attached Figures only furnish a description of specific embodiments.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth ill the claims below.

I claim:

1. A stirrup, comprising:

a first member having a first cross member and first sides extending from said first cross member;

a second member having a second cross member and second sides extending from said second cross member; said second sides slidably mounted on said first sides between an extended position and a retracted position;

a lock disposed on said first and second members and engaging in said extended position locking said second member in said extended position; and a release disengaging said lock upon a downward movement of said second cross member with respect to said first cross member.

2. The stirrup of claim 1 wherein said second sides are mounted exteriorly of said first sides.

3. The stirrup of claim 1 wherein said extended position includes a locked position and a released position wherein said first and second members are locked in said locked position and released in said released position.

4. The stirrup of claim 1 further including fasteners disposed on said second sides protruding into longitudinal slots in said first sides whereby said fasteners slide with said slots.

5. The stirrup of claim 4 wherein said lock includes a catch on said first member releasably engaging said fasteners on said second sides holding said second member in said extended position.

6. The stirrup of claim 5 wherein said catch is a wire keeper on each said first side adapted to receive said fastener in said extended position.

7. The stirrup of claim 4 wherein said lock includes a J-slot in said longitudinal slots adapted to receive said fastener in said extended position.

8. The stirrup of claim 1 wherein said lock includes:

a spring catch having an end rotatably mounted on each first side;

an arm rigidly fixed to each second side; and said arm adapted to slide over said end of said spring catch to lock said second member in said extended position.

9. The stirrup of claim 1 wherein said first and second sides are perpendicular to said cross members and are substantially parallel to each other.

10. The stirrup of claim 1 further comprising a retractor engaging said first and second members biasing said second member from said extended position to said retracted position.

11. The stirrup of claim 10 wherein said first member has a transverse member and said retractor is housed within said transverse member.

12. The stirrup of claim 10 wherein said retractor includes a coiled spring mounted in each end of said transverse member with a flexible member connecting said coiled spring to one of said second sides.

13. The stirrup of claim 10 wherein said retractor includes an elastomeric member having one end attached to said transverse member and another end attached to one of said second sides.

14. A stirrup, comprising:

a first stirrup member;

a second stirrup member slidably connected to the first stirrup member between a first position and a second position on the first stirrup member;

a retraction mechanism biased to move the second stirrup member from the first position to the second position;

first and second protrusions on the second stirrup member slidably received in first and second slots in the first stirrup member;

a lock disposed on the first and second stirrup members engaging in the first position to lock the second stirrup member in the first position; and a release to disengage the lock.

15. The stirrup of claim 1 wherein said lock includes hooks pivotably disposed on said first and second members, said hooks cammingly engaging said protrusions.

16. The stirrup of claim 14 wherein the lock includes at least one wire keeper adapted to hold one of the protrusions in response to the second stirrup member in the first position.

17. The stirrup of claim 14 wherein at least one of the first and second slots has a J-shaped extension, the J-shaped extension being adapted to hold one of the protrusions in response to the second stirrup member being in the first position.

18. The stirrup of claim 14 wherein the lock includes a J-shaped extension in each of the first and second slots, the J-shaped extensions holding the first and second protrusions in response to the second stirrup member being in the first position.

19. The stirrup of claim 14 wherein said first stirrup member has a transverse member and wherein the retraction mechanism is housed in the transverse member biasing the second stirrup member from the first position to the second position.

20. The stirrup of claim 14 wherein said second stirrup member includes hinged sides.

21. The stirrup of claim 14 wherein said second stirrup member has a crossbar connected to adjacent sides by hinges.

22. The stirrup of claim 14 wherein the first and second stirrup members are U-shaped with openings and have substantially narrower widths at the openings of the first and second stirrups members.

23. The stirrup of claim 14 wherein thc retraction mechanism comprises at least one of a cable, a wire, and a line: the one of a cable, a wire, and a line being adapted to transmit a return force from the retraction mechanism to the second stirrup member.

24. The stirrup of claim 23 wherein the retraction mechanism further includes at least one coiled spring capable of producing the return force.

25. The stirrup of claim 14 further comprising a coupling between the first and second stirrup members, the coupling substantially limiting motion between the first and second stirrup members to sliding motion.

26. The stirrup of claim 13 wherein the protrusion includes one of a bolt or a track bar.

27. The stirrup of claim 14 wherein the first stirrup member has a transverse member and wherein the transverse member is partially hollow and holds a portion of the retraction mechanism.

28. The stirrup of claim 14 wherein the sides of the first stirrup member are partially hollow and receive sides of the second stirrup member.

29. A method for facilitating mounting of a riding horse, comprising:

extending a first portion of a stirrup with respect to a second portion of the stirrup;

locking the first portion in an extended position with respect to the second portion;

placing the rider's foot on the extended first portion;

placing the rider's weight on the extended first portion to release the first portion from the second portion; and removing the rider's weight from the first portion to retract the extended first portion to a retracted position adjacent the first portion.

30. The method of claim 29 wherein the act of extending includes manually placing a protrusion coupled to a first stirrup of the stirrup into a locking device on a second stirrup of the stirrup, the device selected from the group consisting of a J-shaped extension slot and a wire keeper.

31. The method as set forth in claim 29 wherein the act of extending includes increasing tension on a spring, the act of retracting being performed by the spring.

32. A method of mounting a riding horse, comprising:

locking a lower foot plate of an extendible stirrup in an extended position;

mounting the riding horse by using the lower foot plate of the extendible stirrup as a step; and unlocking the lower foot plate of the extendible stirrup in response to exerting downward pressure on the lower foot plate.

33. The method of claim 32 wherein the act of locking includes manually maneuvering a protrusion coupled to a first stirrup of the extendible stirrup into a locking device on a second stirrup of the extendible stirrup, the device selected from the group consisting of a J-shaped extension slot, a wire keeper, a spring catch, and a cam mechanism.

34. An extendable stirrup, comprising:

an upper stirrup having upper sides and an upper foot plate connecting said upper sides;

a lower stirrup having lower sides and a lower foot plate connecting said lower sides, said lower stirrup slidably engaged to said upper stirrup between a retracted position and an extended position;

fasteners disposed on said lower sides protruding into longitudinal slots in said upper sides whereby said fasteners slide with said slots;

a lock disposed on said upper and lower stirrups, said lock comprising a hook pivotably disposed on said upper sides, said hook capable of moving from a locked position to an unlocked position;

a release mechanism coupled to said hook and disposed on said upper stirrup;

said hook pivoting to said locked position upon contact with said fasteners as said lower stirrup moves from said retracted position to said extended position; and said locked position holding said lower stirrup in said extended position.

35. The extendable stirrup of claim 34 wherein said release mechanism protrudes through said upper foot plate, said release mechanism pivoting said hook to the unlocked position, thereby allowing the lower stirrup to return to the retracted position.

36. The extendable stirrup of claim 34 further including an upper tread pad disposed about said upper foot plate.

37. The extendable stirrup of claim 36 wherein said upper tread pad has a cavity capable of housing a portion of said release mechanism when said lower stirrup is in said extended position.

38. The extendable stirrup of claim 37 wherein said upper tread pad has an opening allowing a portion of said release mechanism to protrude through said upper tread pad.

39. The extendable stirrup of claim 36 further including a lower tread pad disposed about said lower foot plate.

40. An extendable stirrup, comprising:

a first member having a first cross member and first sides extending from said first cross member, said first sides being substantially parallel to one another;

a second member having a second cross member, second sides extending from said second cross member, and a first groove, said second sides substantially parallel to one another and slidably mounted on said first sides between an extended position and a retracted position;

a lock disposed on said first and second members and engaging in said extended position locking said second member in said extended position, said lock comprising:

bearings disposed within said first cross member and about the outer surface of said second member;

an actuator having a second groove and being disposed within said second member, said bearings resting in said second groove when said lower stirrup is in said retracted position;

a bushing disposed within said second cross member, said bushings having a second hole housing said bearings;

a flat spring disposed between said actuator and said bushing, said spring applying pressure to said bearings via said actuator when said lower stirrup is in said extended position;

said bearings contemporaneously moving from said second grooves into said first grooves when said second member is moved to said extended position, said bearings thereby preventing said second member from returning to the retracted position; and a release disengaging said lock.

41. The extendable stirrup of claim 40 further including an actuator pad disposed on said first cross member, said release disengaging said lock by contemporaneously moving said bearings from said first grooves to said second grooves upon pressure being applied to said actuator pad.

42. The extendable stirrup of claim 40 wherein said second cross members pivot.

* * * * *